US006720135B2

(12) United States Patent
Kondo et al.

(10) Patent No.: US 6,720,135 B2
(45) Date of Patent: Apr. 13, 2004

(54) SILVER HALIDE PHOTOGRAPHIC EMULSION AND SILVER HALIDE PHOTOGRAPHIC MATERIAL BY USE THEREOF

(75) Inventors: Toshiya Kondo, Hino (JP); Tadanobu Sekiya, Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/439,077

(22) Filed: May 15, 2003

(65) Prior Publication Data

US 2003/0224306 A1 Dec. 4, 2003

(30) Foreign Application Priority Data

May 23, 2002 (JP) ..... 2002-149092

(51) Int. Cl.[7] ..... G03C 1/035
(52) U.S. Cl. ..... 430/567

(58) Field of Search ..... 430/567

(56) References Cited

U.S. PATENT DOCUMENTS 6,555,299 B2 * 4/2003 Hosokawa ..... 430/351

* cited by examiner

*Primary Examiner*—Hoa Van Le
(74) *Attorney, Agent, or Firm*—Muserlian, Lucas and Mercanti

(57) ABSTRACT

A silver halide emulsion improved in radiation resistance is disclosed, comprising tabular grains having an average aspect ratio of 20 to 500 and an average spacing between twin planes of 10 to 160 A, and at least 80% by number of the tabular grains being accounted for by hexagonal tabular grains having an adjacent edge ratio of not less than 1.0 and less than 1.2. There is also disclosed a photographic material comprising a silver halide emulsion layer containing the tabular grains.

9 Claims, No Drawings

SILVER HALIDE PHOTOGRAPHIC EMULSION AND SILVER HALIDE PHOTOGRAPHIC MATERIAL BY USE THEREOF

FIELD OF THE INVENTION

The present invention relates to a silver halide photographic emulsion (hereinafter, also denoted as a silver halide emulsion or simply as an emulsion) and a silver halide photographic light sensitive material (hereinafter, also denoted as a photographic material), and in particular to a silver halide photographic emulsion exhibiting enhanced sensitivity and superior graininess, and improved lowering of sensitivity and deterioration of image quality caused by radiation rays, and a silver halide photographic material by use thereof.

BACKGROUND OF THE INVENTION

Recently, popularization of photographing instruments such as cameras have greatly advanced and brought about increased opportunities for picture-taking by use of silver halide photographic materials. Further enhanced sensitivity and image quality are still more strongly desired.

One of the essential factors for enhancement of sensitivity and image quality is silver halide grains and development of silver halide grains aimed at enhancing sensitivity and image quality of photographic material has been promoted in the photographic art.

As is generally conducted, decreasing a silver halide grain size to enhance image quality tends to reduce sensitivity and there were limits to allow enhanced sensitivity to be compatible with enhanced image quality.

There have been studied techniques for enhancing the ratio of sensitivity to grain size to achieve further enhancements of sensitivity and image quality. For example, techniques of using tabular silver halide grains were disclosed in JP-A Nos. 58-111935, 58-111936, 58-111937, 58-113927 and 59-99433 (hereinafter, the term, JP-A refers to an unexamined Japanese Patent Application Publication). Compared to so-called regular crystal silver halide grains such as octahedral, tetradecahedral or cubic grains, tabular silver halide grains have a larger surface area, whereby a larger amount of a sensitizing dye is adsorbed onto the grain surface, advantageously achieving further the enhanced sensitivity. The use of tabular silver halide grains having a still higher aspect ratio (i.e., the ratio of grain diameter to grain thickness) was also disclosed in JP-A Nos. 6-230491, 6-235988, 6-258745 and 6-289516.

JP-A No. 63-92942 disclosed a technique of providing a core having a relatively high iodide content in the interior of tabular silver halide grains and JP-A No. 63-163541 disclosed a technique of using tabular silver halide grains having at least 5 of a ratio of grain thickness to the longest spacing between twin planes, both of which contributed to enhancement of sensitivity and graininess.

JP-A No. 63-106746 disclosed a technique of using tabular silver halide grains substantially having a layer structure parallel to two opposed major faces, and JP-A No. 1-279237 disclosed a technique of using tabular silver halide grains having a layer structure divided by a face substantially parallel to the two opposed major faces and an average surface iodide content higher by at least 1 mol % than an average overall iodide content.

JP-A No. 3-121445 disclosed silver halide grains having parallel twin planes and an interfacial layer having regions differing in iodide content, while JP-A No. 63-305343 disclosed tabular silver halide grains having development initiation points in the vicinity of corners of the grain, and JP-A No. 2-34 disclosed silver halide grains comprising a (100) face and a (111) face.

JP-A No. 1-183644 disclosed tabular silver halide grains having a uniform distribution of iodide content among grains.

There was also disclosed a technique for achieving carrier control by metal-doping, in which a polyvalent metal oxide is occluded within silver halide grains, thereby improving photographic characteristics.

JP-A Nos. 3-196135 and 3-189641 disclosed a silver halide emulsion which was prepared in the presence of an oxidizing agent for silver and associated effects with respect to sensitivity and fogging when using a silver halide photographic material by use of the emulsion. Further, JP-A No. 63-220238 disclosed a silver halide emulsion comprising tabular grains in which the position of dislocation lines is specified; JP-A No. 3-175440 disclosed a silver halide emulsion tabular grains, in which dislocation lines are concentrated near corners of the grain; JP-B No. 3-18695 (hereinafter, the term, JP-B refers to a Japanese Patent Publication) disclosed a technique of using silver halide grains having a definite core/shell structure; and JP-A No. 3-31245 disclosed a technique concerning silver halide grains having core/shell three-layer structure. These techniques were studied to enhance sensitivity.

JP-A Nos. 6-11781, 6-11782, 6-27564, 6-250309, 6-250310, 6-250311, 6-250313 and 6-242527 disclosed the use of iodide ion releasing compounds, achieving improvements in sensitivity, fogging and pressure resistance.

However, in the foregoing prior art, there is a limit to allow enhancing sensitivity to be compatible with enhancing image quality. Recently, effects of natural radiation rays on silver halide color photographic materials using a high-sensitive silver halide emulsion were high-lighted, for example, in "Shashin Kogyo" page 92, No. 11,1986 reported details of the influence of natural radiation rays on high-speed photographic film. Influence of natural radiation rays on silver halide photographic materials is well known to be due to γ-ray and exposure thereto results in an increased fog density, accompanied by deteriorated graininess.

As described above, present techniques for silver halide grains are insufficient for satisfying recent requirements in photographic material and development of superior techniques is still desired. Specifically, development of a technique enabling precise control of sensitivity speck sites and halide composition on the surface of silver halide grains is needed to accomplish still more effective chemical sensitization and spectral sensitization to achieve enhanced photographic performance and the foregoing techniques do not sufficiently meet such requirements.

SUMMARY OF THE INVENTION

The present invention has come into being in view of the foregoing situation. Thus, it is an object of the invention to provide a silver halide photographic emulsion exhibiting enhanced sensitivity and superior graininess, improved in lowering of sensitivity and deterioration of image quality caused by radiation rays, and a silver halide photographic material by use the same.

The object of the invention was accomplished by the following constitution:

1. A silver halide photographic emulsion comprising silver halide grains, wherein 70% to 100% of total grain projected area is accounted for by tabular grains, the tabular grains having an average aspect ratio of 20 to 500 and an average spacing between twin planes of 10 to 160 A, and at least 80% by number of the tabular grains being accounted for by hexagonal tabular grains having an adjacent edge ratio of not less than 1.0 and less than 1.2;

2. A silver halide photographic emulsion comprising silver halide grains, wherein the silver halide grains have an average aspect ratio of 20 to 500 and a spacing between twin planes of 10 to 160 A, and at least 80% by number of the silver halide grains is accounted for by hexagonal tabular grains having a adjacent edge ratio of not less than 1.0 and less than 1.2;
3. A silver halide photographic material comprising on a support at least one silver halide emulsion layer, wherein the silver halide emulsion layer comprises a silver emulsion, as described above.

DETAILED DESCRIPTION OF THE INVENTION

One aspect of this invention concerns a silver halide photographic emulsion, in which 70 to 100% of the total grain projected area is accounted for by tabular grains, the tabular grains have an average aspect ratio of 20 to 500, 80 to 100% by number of the tabular grains is accounted for by hexagonal tabular grains having an adjacent edge ratio of not less than 1.0 and less than 1.2, and the tabular grains have an average spacing between twin planes of 10 to 160 A.

In this invention, the tabular grains refer to those having an aspect ratio of more than 3. The tabular grains account for 70 to 100%, preferably 80 to 100%, and more preferably 90 to 100% of the total grain projected area. Less than 70% often results in insufficient compatibility of enhanced sensitivity with superior radiation resistance.

The tabular grains are crystallographically classified as twinned crystal grains. The twinned crystal grains refer to crystal grains having at least one twinned plane within the grain. Classification of silver halide twinned crystal grains is described in Klein & Moisar's report (Photographishe Korrespondenz, vol. 99, page 99, and vol. 100, page 57). Tabular grains relating to the invention are those having at least two twinned planes parallel to the major faces.

The tabular silver halide grains preferably at least two parallel twin planes within the grain. The twin planes exist substantially parallel to a face having the largest area of faces forming the surface of the tabular grain, which is called major face(s). In one preferred embodiment of the invention, two twin planes exist parallel to the major faces. Silver halide grains having two twin planes parallel to the major faces preferably account for at least 80%, more preferably 90%, and still more preferably 95% by number of the grains. In this invention, the average of spacing(s) of at least two twin planes parallel to the major faces (which is, hereinafter, also denoted as an average spacing between at least two twin planes or simply as average twin plane spacing) is 10 to 160 A, preferably 10 to 140 A, and more preferably 10 to 120 A. The spacing between at least two twin planes is the distance between the two twin planes measured vertical to the twin planes in the grain. An average spacing between at least two twin planes of less than 10 A makes it difficult to maintain uniformity of shape or size of silver halide grains. An average spacing between at least two twin planes of more than 160 A makes it difficult to achieve an average aspect ratio of 20 to 500. A coefficient of variation of a spacing between at least two twin planes preferably is not more than 40%, and more preferably not more than 30%.

The twin plane can be observed directly with a transmission electron microscope. Thus, a photographic emulsion is coated on a support to prepare a sample so that the major face of tabular grains contained are arranged parallel to the support surface. The thus prepared sample is cut using a diamond cutter to obtain ca. 0.1 μm thick slices. The presence of twin plane(s) can be confirmed through observation of this slice using a transmission electron microscope. In the invention, the spacing between two twin planes of the tabular grains is determined in such a manner that in the foregoing transmission electron microscopic observation of the slice, at least 100 tabular grains exhibiting a section vertical to the major faces are selected, then, the spacing between at least two twin planes is determined for each grain and the thus obtained spacing are averaged for total grains to determine the spacing between twin planes as defined in the invention.

The spacing between at least two twin planes (hereinafter also denoted simply as twin plane spacing) can be controlled by the optimum selection or combination of factors influencing super-saturation at the nucleation stage, such as gelatin concentration, temperature, iodide ion concentration, pBr, ion supplying rate, stirring speed, and gelatin species. In general, nucleation at a highly super-saturated state shortens the twin plane spacing. The super-saturation factors are detailed, for example, in JP-A Nos. 63-92942 and 1-213637.

In this invention, the tabular grains refer to those having an aspect ratio of more than 3.

In the silver halide emulsion of this invention, an average aspect ratio of tabular grains is 20 to 500, preferably 25 to 500, and more preferably 30 to 500. An average aspect ratio of less than 20 does not often achieve sufficiently improved radiation resistance and an average aspect ratio of more than 500 deteriorates graininess and radiation resistance. The aspect ratio of silver halide grains is defined in the following equation and can be determined by measuring the grain diameter and thickness for the respective grains:

$$\text{Aspect ratio} = \text{grain diameter}/\text{grain thickness}$$

The tabular silver halide grains relating to this invention preferably are those having (111) major faces and two twin planes parallel to the major faces, in which the average grain diameter preferably is 0.3 to 50 μm, more preferably 1.0 to 50 μm, and still more preferably 3.5 to 50 μm. An average diameter of less 0.3 μm makes it difficult to obtain sensitivity necessitated as silver halide photographic material. An average grain diameter exceeding 50 μm markedly deteriorates graininess.

The average grain diameter is an arithmetic mean of grain diameter $r_i$, to the third significant figure, with the final figure rounded and at least 1,000 grains selected at random are measured. The grain diameter, $r_i$ is a diameter of a circle having an area equivalent to the projected area vertical to the major face in the case of a tabular grain (hereinafter, also denoted as an equivalent circle diameter). The grain size ($r_i$) can be determined by measuring the grain diameter or projection area in 10,000 to 70,000 power electron micrographs of silver halide grains.

The tabular silver halide grains relating to this invention preferably have a grain thickness of not more than 0.25 μm, more preferably 0.005 to 0.20 μm, and still more preferably 0.005 to 0.10 μm. A grain thickness of less than 0.005 μm often makes it difficult to maintain uniformity in silver halide grain shape and size; and a grain thickness exceeding 0.2 μm often causes deterioration in sharpness. A coefficient of variation of thickness of the tabular silver halide grains preferably is not more than 40% and more preferably not more than 30%.

To determine the grain diameter or aspect ratio of silver halide grains, the projected area or thickness for each grain can be determined in accordance with the following procedure. A sample is prepared by coating a tabular grain emulsion containing a latex ball having a known diameter as an internal standard on a support so that the major faces are arranged in parallel to the support surface. After being subjected to shadowing by carbon vapor evaporation, replica sample is prepared in any of the conventional replica methods. From electron micrographs of the sample, a diameter of a circle equivalent to the grain projected area and grain thickness are determined using an image processing apparatus. In this case, the grain projected area can be determined from the internal standard and the projection area and the grain thickness can be determined from the internal standard and silver halide grain shadow.

Any silver halide emulsion, such as a polydisperse emulsion having a relative wide grain size distribution or a monodisperse emulsion of a relatively narrow grain size distribution can be used in this invention and a monodisperse emulsion is preferred. The monodisperse emulsion is one having a grain size distribution (or coefficient of variation of grain size), as defined below, of less than 40%, and preferably less than 30%:

Grain size distribution (%)=(standard deviation of grain size/average grain size)×100 wherein the average grain size and standard deviation can be determined from the grain diameter, $r_i$ defined above.

In the tabular silver halide grains of this invention, 80 to 100% by number of the tabular grains is accounted for by hexagonal tabular grains having an adjacent edge ratio of not less than 1.0 and less than 1.2. An adjacent edge ratio of not less than 1.2 results in insufficient improvements in graininess and radiation resistance. In less than 80% of the hexagonal tabular grains having an adjacent edge ratio of not less than 1.0 and less than 1.2, there cannot be simultaneously achieved enhanced sensitivity and superior graininess as well as improved radiation resistance. In this invention, the hexagonal tabular grains refer to those which have a ratio of a linear length of an edge to that of an adjacent edge of 0.2 to 10.0, when electron-microscopically observing a replica sample coating silver halide grains so that the major faces of the grains are oriented parallel to the substrate. Of adjacent two edges of the hexagonal tabular grain, the ratio of a longer edge length to a shorter edge length is determined for the respective edges of the grain and the maximum ratio thereof is defined as the adjacent edge ratio of the hexagonal tabular grain of this invention. In the case of the adjacent edge lengths being equal, the adjacent edge ratio is to be 1.0. In this invention, the hexagonal tabular silver halide grains having an adjacent edge ratio of not less than 1.0 and less than 1.2 account for 80 to 100% (or at least 80%), preferably 85 to 100%, and more preferably 90 to 100% of the tabular grains. In this invention, hexagonal tabular silver halide grains having an adjacent edge ratio of not less than 1.0 and not more than 1.1 account for 50 to 100%, preferably 70 to 100%, and more preferably 80 to 100% of the tabular grains. In the determination of the edge ratio, the number of grains randomly is at least 1000.

In the silver halide emulsion relating to this invention, the percentage of heteromorphic grains preferably is 0 to 5%, more preferably 0 to 3% and still more preferably 0 to 2% by number of the total grains. The heteromorphic grains exceeding 5% by number of the total grains results in increased fogging and deteriorated graininess and radiation resistance. In this invention, the heteromorphic grains refer to silver halide twinned crystal grains having an aspect ratio of not more than 3 and at least one twin plane, including, for example, trigonal tabular grains, non-tabular multi-twinned crystal grains and stick-like grains. In this invention, the percentage of the heteromorphic twinned grains preferably is 0 to 3%, more preferably 0 to 2% and still more preferably 0 to 1% by number.

In this invention, heteromorphic twinned grains are silver halide grains included in the foregoing heteromorphic grains, and are those other than the stick-like grains, which are silver halide twinned crystal grains having plural non-parallel twin planes within the grain. The stick-like grains refer to silver halide grains, the shape of which are recognized as a stick form or a needle form and which meet the following requirement, $a/b \geqq 3$, in which "a" is the longest length in the major axis direction and "b" is the longest length in the minor axis direction. The proportion of heteromorphic grains or heteromorphic twinned grains is determined by measuring at least 10,000 and preferably at least 50,000 silver halide randomly selected grains. Using samples used for the foregoing determination of diameter or aspect ratio of silver halide grains, the number of the heteromorphic grains or heteromorphic twinned grains can be determined from electron micrographs of at least 10,000 grains and preferably 50,000 randomly selected grains.

The silver halide emulsion of this invention is preferably comprised of silver halide grains having an average iodide content of 0.1 to 30 mol %, and more preferably 0.3 to 20 mol %, and still more preferably 0.5 to 15 mol %. The iodide content of silver halide grains can be determined in the EPMA method (Electron Probe Micro Analyzer method). Thus, silver halide grains are dispersed so as to be not in contact with each other to prepare a sample. The sample is irradiated with an electron beam, while cooling at a temperature of not more than 100° C. using liquid nitrogen, and characteristic X-ray intensities of silver and iodine, radiated from a single silver halide grain are measured to determine iodide contents of the grain. According to the foregoing manner, iodide contents determined for respective grains are measured for at least 100 grains and an averaged value thereof are defined as an average iodide content of the grains.

The silver halide grains relating to this invention preferably include plural silver halide phases differing in iodide content in the interior of the grain. Core/shell type silver halide grains are also preferred, having external silver halide phase having a higher or lower iodide content than the internal phase. Any number of the plural internal silver halide phases differing in iodide content may be feasible and the silver halide grains preferably comprise at least 3 phases, more preferably at least 4 phases, and still more preferably at least 5 phases. There are also preferred tabular silver halide grains, as described in JP-A No. 2000-305211, each have at lease 5 phase structure comprising an internal phase, a first high iodide localizing phase, an intermediate phase, a second high iodide localizing phase and a shell phase in this order from the grain center, in which the internal phase accounts for 5 to 60%, based on total silver and having an average iodide content of 0 to 10 mol %, the first and second high iodide localizing phases each account for 0.5 to 5%, based on total silver and having an average iodide content of 40 to 100 mol %, the intermediate phase accounts for 10 to 70%, based total silver and having an average iodide content of 0 to 10 mol %, and the shell phase accounts for 10 to 50%, based on total silver and having an average iodide content of 0 to 10 mol %; tabular grains, as described in JP-A 2000-321699, each have at lease 5 phase structure comprising a core, a first shell, a second shell, a third shell and a fourth shell in this order from the grain center, in which the core accounts for 5 to 50%, based on total silver and having an average iodide content of 0 to 3 mol %, the first shell account for 5 to 30%, based on total silver and having an average iodide content of 3 to 10 mol %, the second shell account for 10 to 30%, based on total silver and having an average iodide content of 0 to 3 mol %, the third shell accounts for 0.5 to 5%, based total silver and having an average iodide content of 40 to 100 mol %, and the fourth shell phase accounts for 10 to 40%, based on total silver and having an average iodide content of 3 to 10 mol %. Tabular silver halide grains comprising plural silver halide phases are also preferred, as described in JP-A Nos. 2000-258863, 2001-100346 and 2001-242576.

The tabular silver halide grains relating to this invention preferably contain dislocation lines and the form the dislocation lines can optimally be selected. For example, there are selected dislocation lines that are linearly exist in a specific crystallographic direction, or curved dislocation lines. There are also selected dislocation lines existing overall within the grain or dislocation lines existing in a specific site of the grain, for example, in the form of dislocation lines localizing in the fringe portions (circumferential portion) of the grain, those localizing in the major faces or those localizing in the vicinity of corners of the grain. In this invention, 50 to 100% by number of the tabular grains contain at least 20 dislocation lines (more preferably at least 30 dislocation lines) in the fringe portion of the grain, in terms of graininess and sensitivity. 1,000 or more dislocation lines are difficult for measurement thereof.

The dislocation lines in silver halide grains can be directly observed by means of transmission electron microscopy at a low temperature, for example, in accordance with methods described in J. F. Hamilton, Phot. Sci. Eng. 11 (1967) 57 and T. Shiozawa, Journal of the Society of Photographic Science and Technology of Japan, 35 (1972) 213. Silver halide tabular grains are taken out from an emulsion while making sure not to exert any pressure that causes dislocation in the grains, and they are then placed on a mesh for electron microscopy. The sample is then observed by transmission electron microscopy, while being cooled to prevent the grain from being damaged by the electron beam. Since electron beam penetration is hampered as the grain thickness increases, sharper observations are obtained when using an electron microscope of higher voltage (e.g., at a voltage 200 kV or more for a 0.25 $\mu$m thick grain). From the thus-obtained electron micrograph, the position and number of the dislocation lines in each grain can be determined. Any of several methods for introducing the dislocation lines into the silver halide grain may be used.

In the invention, the expression "having dislocation lines in the fringe portion of the grain" means that the dislocation lines exist in the vicinity of the circumferential portion, in the vicinity of the edge or in the vicinity of the corner of the tabular grain. Concretely, when the tabular grain is observed vertical to the major face of the grain and a length of a line connecting the center of the major face (i.e., a center of gravity of the major face, which is regarded as a two-dimensional figure) and a corner is represented by "L", the fringe portion refers to the region outside the figure connecting points at a distance of 0.50L from the center with respect to the respective corners of the grain.

In the tabular silver halide grains relating to this invention, those having dislocation lines in the major faces preferably account for at least 50% by number, and more preferably at least 70% by number of the tabular grains. Further, in the tabular silver halide grains, those having dislocation lines in the fringe portion and the major faces preferably account for at least 50% by number, and more preferably at least 70% by number of the tabular grains.

The dislocation lines can be introduced by various methods, in which, at a desired position of introducing the dislocation lines during the course of forming silver halide grains, an aqueous iodide (e.g., potassium iodide) solution is added, along with an aqueous silver salt (e.g., silver nitrate) solution by a double jet technique, only an iodide solution is added, iodide-containing fine grains are added or an iodide ion releasing agent is employed, as disclosed in JP-A No. 6-11781. Of these, the double jet addition of an aqueous iodide solution and an aqueous silver salt solution, addition of iodide-containing fine grains and addition of an iodide ion releasing agent are preferred.

Specifically, the iodide ion releasing agent, which is a compound capable of releasing an iodide ion upon reaction with a base or a nucleophilic reagent is represented by the following formula:

R—I formula (1)

where R is a univalent organic group. R is preferably an alkyl group, alkenyl group, alkynyl group, aryl group, aralkyl group, heterocyclic group, acyl group, carbamoyl group, alkyloxycarbonyl group, aryloxycarbonyl group, alkylsulfonyl group, arylsulfonyl group, or sulfamoyl group. R is also preferably an organic group having 30 or less carbon atoms, more preferably 20 or less carbon atoms, and still more preferably 10 or less carbon atoms. R may be substituted by at least one substituent. The substituent may be further substituted. Preferred examples of the substituent include a halogen atom, alkyl group, aryl group, aralkyl group, heterocyclic group, acyl group, acyloxy group, carbamoyl group, alkyloxycarbonyl group, aryloxycarbonyl group, alkylsulfonyl group, arylsulfonyl group, or sulfamoyl group, alkoxy group, aryloxy group, amino group, acylamino group, ureido group, urethane group, sulfonylamino group, sulfinyl group, phosphoric acid amido group, alkylthio group, arylthio group, cyano, sulfo group, hydroxy, and nitro.

The iodide ion releasing agents (R—I) are preferably iodo-alkanes, a iodo-alcohol, iodo-carboxylic acid, iodo-amid, and their derivatives, more preferably iodo-amide, iodo-alcohol and their derivatives, still more preferably iodo-amide substituted by a heterocyclic group, and specifically preferable examples include (iodoacetoamido) bebzenesulfonat.

Preferred examples of the iodide ion releasing agent are shown below.

(1) $I(CH_2)_2OH$ (2) $I(CH_2)_3OH$ (3) $I(CH_2)_4OH$ (4) $ICH_2COOH$ (5) $I(CH_2)_2COOH$ (6) $I(CH_2)_3COOH$ (7) $ICH_2CONH_2$ (8) $I(CH_2)_2CONH_2$ (9) $I(CH_2)_3CONH_2$ (10)

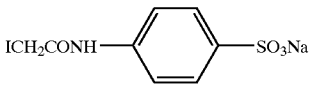

(11)

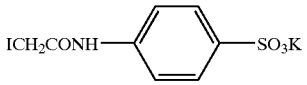

-continued (12)

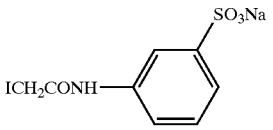

(13)

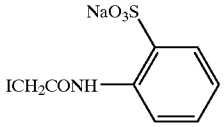

In cases when the iodide ion releasing agent is reacted with a nucleophilic agent (or nucleophile) to release an iodide ion, preferred nucleophilic agents include, for example, preferred nucleophilic agents include hydroxy ion, sulfite ion, thiosulfate ion, sulfonic acid ioncarboxylic acid ion, ammonia, amines, alcohols, ureas, thioureas, phenols, hydrazines, sulfides, and hydroxamic acids. Of these, hydroxy ion, sulfite ion, thiosulphate ion, sulfonic acid ion, carboxylic acid ion, ammonia and amines are more preferred, and hydroxy ion and sulfite ion are specifically preferred.

When dislocation lines are introduced into silver halide emulsion grains using the iodide ion releasing agent, preferred reaction conditions are as follows. Thus, the reaction temperature is preferably 30 to 80° C., and more preferably 40 to 70° C. The pAg immediately before introduction of dislocation lines is preferably 7.0 to 10.0, and more preferably 7.5 to 9.5. The iodide ion releasing agent is added preferably in an amount of 1 to 5 mol %, based on the total amount of silver halide. The pH at the time of an iodide ion releasing reaction is preferably 7.0 to 11.0, and more preferably 8.0 to 10.0. In cases when a nucleophilic agents other than a hydroxy ion, the amount thereof is preferably 0.25 to 2.0 times, more preferably 0.5 to 1.5, and still more preferably 0.8 to 1.2 times that of the iodide ion releasing agent.

When dislocation lines are introduced into silver halide emulsion grains using an iodide containing fine grain emulsion, preferred reaction conditions are as follows. Thus, the emulsion is added preferably at a temperature of 30 to 80° C. and more preferably 40 to 70° C. The amount of the iodide containing fine grain emulsion preferably is 1 to 5 mol %, based on the total amount of silver halide after completion of grain growth.

The tabular silver halide grains relating to this invention preferably have an average surface iodide content of 0.5 to 20 mol %, and more preferably 1 to 15 mol %. The surface iodide content defined in the invention refers to an iodide content in a silver halide phase in a depth of 50 A from the grain surface.

The surface iodide content of silver halide grains can be determined by the XPS method (X-ray Photoelectron Spectroscopy) in the following manner. Thus, a sample is cooled to a temperature of −110° C. or less in a ultra high vacuum of $1.33\times10^{-6}$ Pa or less, then, exposed to X-rays for probe of MgKα at an X-ray source voltage of 15 kV and an X-ray source current of 40 mA, and measured with respect to Ag3d5/2, Br3d, and I3d3/2 electrons. The integral peak intensity is corrected by a sensitivity factor and halide composition on the outer surface layer is determined from the thus obtained intensity ratio. The XPS method is described in JP-A 2-24188, as a method for determining the iodide content on the silver halide grain surface. When measured at room temperature, however, the outer surface iodide content could not be precisely determined due to destruction of the sample accompanied with X-ray exposure. However, the inventors of this application succeeded in precisely determining the outermost surface iodide content by cooling the sample to a temperature so that destruction of the sample was not caused. As a result, it was proved that in grains differing in halide composition between the surface and the interior, such as core/shell grains and in grains having a high iodide layer or a low iodide layer localized on the outermost surface, the value measured at room temperature differs greatly from net composition, due to decomposition of silver halide and diffusion of halides (specifically, iodide) caused by exposure to X-rays.

Specifically, the XPS method used in this invention is carried out according to the following procedure. Thus, a 0.05 wt. % aqueous proteinase solution is added to a silver halide emulsion sample and stirred at 45° C. for 30 min. to degrade the gelatin. The emulsion is subjected to centrifugal separation to allow emulsion grains to sediment, followed by removing the supernatant liquid. Then, distilled water is added thereto to disperse emulsion grains in water and thinly coated on a mirror-polished silicon wafer to prepare a test sample. Surface iodide measurement by the XPS method was conducted using the thus prepared sample. To prevent destruction of the sample caused by X-ray exposure, the sample is cooled to a temperature of −110 to −120° C. in a closed chamber for XPS measurement. The sample was exposed to an X-ray for probe of MgKα at an X-ray source voltage of 15 kV and an X-ray source current of 40 mA, and measured with respect to Ag3d5/2, Br3d, and I3d3/2 electrons. The integral peak intensity is corrected for by a sensitivity factor and halide composition on the outer surface layer is determined from the thus obtained intensity ratio.

Silver halide emulsions relating to this invention preferably contain polyvalent metals, a polyvalent metal ions, polyvalent metal complexes or polyvalent metal ion complexes in the interior or surface of silver halide grains. The polyvalent metals, a polyvalent metal ions, polyvalent metal complexes or polyvalent metal ion complexes in the interior or surface of silver halide grains include, for example, metal atoms, ions, their complexes and salts thereof, selected from 3 to 7 series (specifically, 4 to 6 series) of the periodic table, such as elements of Fe, Co, Ni, Ru, Rh, Pd, Re, Os, Ir, Pt, Mg, Al, Ca, Sc, Ti, V, Cr, Mn, Cu, Zn, Ga, Ge, As, Se, Sr, Y, Mo, Zr, Nb, Cd, In, Sn,Sb, Ba, La, W, Au, Hg, Tl, Pb, Bi, Ce and U, and compounds containing the foregoing metals. The metal compound to be doped is used preferably in the form of a single salt or a metal complex. The metal complex preferably is a six, five, four or two coordination complex and an octahedral six coordination complex or a planar four coordination complex is more preferred. The metal complex may be a mononuclear or polynuclear complex. Examples of ligands constituting the complex include $CN^-$, CO, $NO_2^-$, 1,10-phenanthroline, 2,2'-bipirydine, $SO_3^-$, ethylenediamine, $NH_3$, pyridine, $H_2O$, $NCS^-$, $NCO^-$, $NO_3^-$, $SO_4^-$, $OH^-$, $CO_3^{2-}$, $SSO_3^{2-}$, $N_3^-$, $S_2^-$, $F^-$, $Cl^-$, $Br^-$ and $I^-$. In the case of $NCS^-$, either the N-atom or S-atom can coordinate.

To allow the foregoing polyvalent metals to be contained in silver halide emulsions used in this invention, the following commonly known techniques are applicable: B. H. Carroll, "Iridium Sensitization: A Literature Review", Photogr. Sci. Eng., vol. 24, No. 6, page 265–267 (1980); U.S. Pat. Nos. 1,951,933, 2,628,167, 3,687,676, 3,761,267, 3,890,154, 3,901,711, 3,901,713, 4,173,483, 4,269,927, 4,413,055, 4,477,561, 4,581,327, 4,643,965, 4,806,462, 4,828,962, 4,835,093, 4,902,611, 4,981,780, 4,997,751, 5,057,402, 5,134,060, 5,153,110, 5,164,292, 5,166,044, 5,204,234, 5,166,045, 5,229,263, 5,252,451, 5,252,530; EPO No. 0244184, 0488737, 0488601, 0368304, 0405938, 0509674, 0563046; WO No. 93/02390. Further, U.S. Pat. Nos. 4,847,191, 4,933,272, 4,981,781, 5,037,732, 937,180, 4,945,035, 5,112,732: EPO No. 0509674, 0513738; WO No.

91/10166, 92/16876; German Patent No. 298,320; and U.S. Pat. Nos. 5,360,712 and 5,024,931.

Further, Research Disclosure (hereinafter, also denoted simply as RD) vol. 367, November 1994, item 36736 comprehensively describes criteria to select dopants forming a shallow electron trap. Of the foregoing polyvalent metal atoms, their ions, and complexes and complex ions, six-coordinate complex ions represented by the following formula are preferred:

$$[ML_6]$$

wherein M is a filled frontier orbital polyvalent metal ion and preferably $Fe^{2+}$, $Ru^{2+}$, $Os^{2+}$, $Co^{2+}$, $Rh^{2+}$, $Ir^{2+}$, $Pd^{4+}$, or $Pt^{4+}$; $L_6$ represents six coordinated ligands which are independently selected, provided that at least four of the ligands are each an anionic ligand, and at least one of the ligands (preferably at least three, and more preferably at least four of the ligands) is more electronegative than a halide ligand; and n is 1-, 2-, 3- or 4-.

Examples of a dopant or dopant ion capable of providing a shallow electron trap are shown below:

SET-1 $[Fe(CN)_6]^{4-}$
SET-2 $[Ru(CN)_6]^{4-}$
SET-3 $[Os(CN)_6]^{4-}$
SET-4 $[Rh(CN)_6]^{3-}$
SET-5 $[Ir(CN)_6]^{3-}$
SET-6 $[Fe(pyrazine)(CN)_5]^{4-}$
SET-7 $[RuCl(CN)_5]^{4-}$
SET-8 $[OsBr(CN)_5]^{4-}$
SET-9 $[RhF(CN)_5]^{3-}$
SET-10 $[IrBr(CN)_5]^{3-}$
SET-11 $[FeCO(CN)_5]^{3-}$
SET-12 $[RuF_2(CN)_4]^{4-}$
SET-13 $[OsCl_2(CN)_4]^{4-}$
SET-14 $[RhI_2(CN)_4]^{3-}$
SET-15 $[IrBr_2(CN)_4]^{3-}$
SET-16 $[Ru(CN)_5(OCN)]^{4-}$
SET-17 $[Ru(CN)_5(N_3)]^{4-}$
SET-18 $[Os(CN)_5(SCN)]^{4-}$
SET-19 $[Rh(CN)_5(SeCN)]^{3-}$
SET-20 $[Ir(CN)_5(HOH)]^{2-}$
SET-21 $[Fe(CN)_3Cl_3]^{3-}$
SET-22 $[Ru(CO)_2(CN)_4]^{-}$
SET-23 $[Os(CN)Cl_5]^{4-}$
SET-24 $[Co(CN)_6]^{3-}$
SET-25 $[Ir(CN)_4(oxalate)]^{3-}$
SET-26 $[In(NCS)_6]^{3-}$
SET-27 $[Ga(NCS)_6]^{3-}$ Ir compounds usable in this invention preferably are $K_2IrCl_6$, $K_3IrCl_6$ and $K_2IrBr_6$. Further preferred examples of other polyvalent metal compounds include $InCl_3$, $K_4Fe(CN)_6$, $K_3Fe(CN)_6$, $K_4Ru(CN)_6$ and $Pb(NO_3)_2$. In this invention, at least one selected from polyvalent metal atoms and their ions, complexes and complex ions is used and atoms of Ir, Ru, Os, Fe, Rh, Co, In, Ga, Ge, Pd and Pt, their ions and complexes thereof are specifically preferred.

To allow the foregoing polyvalent metal atoms, their ions, complexes and complex ions to be include in the silver halide emulsion, silver halide grains may be doped during grain growth or during grain ripening. Alternatively, grain growth is interrupted and after being doped, the growth may further continue. Alternatively, after completion of grain growth, a dopant may be introduced into the grain surface. Doping can also be conducted by carrying out nucleation, physical ripening or grain formation in the presence of a dopant. The dopant concentration is preferably $1\times10^{-7}$ to $1\times10^{-2}$ mol, more preferably $1\times10^{6}$ to $1\times10^{-3}$ mol, and still more preferably $2\times10^{-6}$ to $1\times10^{-4}$ mol per mol of silver halide.

To allow polyvalent metals to be occluded in silver halide grains, such metal compounds may be directly dispersed in a silver halide emulsion or added to the emulsion through solution in solvents such as water, methanol and ethanol. Alternatively, addition of commonly known additives into the emulsion may be applicable. At least one selected from polyvalent metal atom, or its ion, complex or complex ion may be added together with fine silver halide grains, or there may be added fine silver halide grains containing at least one of polyvalent metal atom, or its ion, complex or complex ion. A preparation method using fine silver halide grains containing at least one of polyvalent metal atom, or its ion, complex or complex ion is referred to JP-A No. 11-212201.

Silver halide emulsions relating to this invention preferably are silver bromide, silver iodobromide or silver iodochlorobromide, and more preferably silver iodobromide or silver iodochlorobromide. The chloride content preferably is 0 to 50 mol %, more preferably 0 to 30 mol %, and still more preferably 0 to 10 mol %. The silver halide emulsion is preferably comprised of silver halide grains internally having plural silver halide phases differing in iodide content. In one embodiment of this invention, the silver halide emulsion is preferably comprised of core/shell type tabular grains having plural silver halide phases differing in halide composition. The core/shell type grains preferably comprise at least 3 phases, and more preferably at least 4 phases differing in halide composition. In one preferred embodiment of this invention, the silver halide grains preferably comprise at least 5 phases. In this regard, the difference in halide content between adjacent phases preferably is at least 1 mol %, and more preferably at least 3 mol %.

Silver halide emulsions relating to this invention may have any halide composition, and silver iodobromide or silver iodochlorobromide is preferred. In the core/shell type grains, the difference in iodide content preferably is at least 1 mol %, and more preferably at least 3 mol %. The difference in volume between phases of the core/shell type grains preferably is at least 1%, more preferably at least 3%, and still more preferably 5%. The core/shell type grains may be comprised of a high iodide or low iodide internal phase or alternately comprised of a high iodide phase and a low iodide phase. The outermost layer of the core/shell type grains preferably is a low iodide phase containing less than 3 mol % iodide, more preferably less than 1 mol % iodide, and still more preferably no iodide.

Nucleation in the process of forming silver halide emulsions relating to this invention is preferably conducted in the presence of a low molecular weight gelatin having an average molecular weight of 5,000 to 70,000 and/or a gelatin having a methionine content of less than 30 $\mu$mol/g. The methionine content at the nucleation stage is more preferably less than 20 $\mu$mol/g, and still more preferably 0 to 10 $\mu$mol/g. The average molecular weight of a low molecular gelatin is more preferably 6,000 to 50,000, and still more preferably 7,000 to 30,000.

Oxidation of alkali-processed gelatin by using oxidizing agents is useful to achieve a methionine content of less than 30 $\mu$mol/g. Oxidizing agents to oxidize gelatin include, for example, hydrogen peroxide, ozone, peroxy-acid, halogen, thiosulfonic acid compounds, quinines, and organic peracids. Of these, hydrogen peroxide is preferred. Determination of the methionine content is described in many literatures. Amino acid analysis, HPLC method, gas chromatography and silver ion titrimetry are employed with reference to, for example, Journal of Photographic Science, vol. 28, page 111; ibid, vol. 40, page 149; ibid, vol. 41, page 172; ibid, vol. 42, page 117; and Journal of Imaging Science and Technology, vol. 39, page 367.

The foregoing low methionine containing gelatin having a methionine content of less than 30 μmol/g is preferably used in the nucleation stage but may be used in the subsequent ripening and growth stage. The low molecular weight gelatin can be obtained by subjecting conventional gelatin to hydrolysis, enzymatic degradation using proteinase or by breaking crosslinkage using ultrasonic irradiation. In cases when the low molecular weight gelatin and/or low methionine gelatin having a methionine content of less than 30 μmol/g are used in any stage other than the nucleation stage, any dispersing medium is usable. Preferred examples of a dispersing medium used in silver halide emulsions relating to this invention include gelatin and hydrophilic colloids.

There is preferably used gelatin such as alkali or acid processed gelatin having a molecular weight of the level of 100,000 or enzyme-treated gelatin described in Bull. Soc. Sci. Photo. Japan No. 16, pp. 30 (1966). Examples of the hydrophilic colloid include gelatin derivatives, graft polymers of gelatin and other polymers, proteins such as albumin and casein, cellulose derivatives such as hydroxyethyl cellulose, carboxymethyl cellulose, cellulose sulfuric acid ester, saccharide derivatives such as sodium alginate and starch derivatives and synthetic hydrophilic polymer material including homopolymers such as polyvinyl alcohol, polyvinyl alcohol partial acetal, poly(N-vinyl pyrrolidine), polyacrylic acid, polymethacrylic acid, polyacrylamide, polyvinyl imidazole, and polyvinyl pyrazolo, and their copolymers.

Chemically modified gelatin may also preferably used in the growth stage of silver halide grains. Chemically modified gelatins include, for example, gelatin, an amino group of which is substituted, as described in JP-A Nos. 5-72658, 9-197595 and 9-251193.

There may be used polyalkyleneoxide compounds described in U.S. Pat. No. 5,252,453. There may also be used crystal face-controlling agents (or crystal habit controlling agents) described in U.S. Pat. Nos. 4,680,256, 4,684,607, 4,680,254 and 4,680,255. In this invention, any proportion of (111) face or (100) face in the side faces of tabular silver halide grains are applicable, and a proportion of (100) face in the side faces preferably is at least 20%, and more preferably at least 30%. In cases when reduction sensitization is conducted in the process of forming silver halide grains, there may be used a radical scavenger or additive controlling oxidation of a silver nucleus.

The nucleation stage in the process of forming silver halide emulsions is preferably conducted at a temperature of less than 30° C., and more preferably less than 21° C. The silver halide emulsions are ripened or grown preferably at 30 to 90° C., and more preferably 40 to 80° C.

Silver halide emulsions used in this invention may be subjected to reduction sensitization. The reduction sensitization can be conducted by adding a reducing agent to a protective colloid solution used for grain growth. Alternatively, the protective colloid solution used for grain growth is ripened or mixed at a low pAg of 7 or less or at a high pH of 7 or more. These procedures may be conducted singly or in combination thereof.

Examples of preferred reducing agents include thiourea dioxide, ascorbic acid and its derivatives, and tin (II) salt. Other reducing agents include, for example, borane compounds, hydrazine compounds, silane compounds, amines and polyamines. The reducing agent is added preferably in an amount of $10^{-8}$ to $10^{-2}$ mol, and more preferably $10^{-7}$ to $10^{-3}$ mol per mol of silver halide. In cases when the reduction sensitization is carried out by maintaining a protective colloid solution at a pAg less than 7.0, a silver salt is added to the protective colloid solution to adjust the pAg to an appropriate value, followed by ripening or growing silver halide grains. The silver salt preferably is a water soluble silver salt, and more preferably silver nitrate. The pAg is preferably not more than 7.0, and more preferably 2.0 to 5.0 (in which the pAg is a common logarithm of the reciprocal of $Ag^+$ concentration). In cases when the reduction sensitization is carried out by maintaining a protective colloid solution at a pH higher than 7.0, an alkaline compound is added to the protective colloid solution to adjust the pH to an appropriate value, followed by ripening or growing silver halide grains. Examples of the alkaline compound include sodium hydroxide, potassium hydroxide and ammonia, and compounds other than ammonia are preferred.

Reducing agents, silver salts or alkaline compounds may be added instantaneously or added over a period of a given time to perform reduction sensitization, in which the addition thereof may be conducted at a constant flow rate or at an accelerated flow rate. The addition may be dividedly carried out. Prior to addition of a water-soluble silver salt and/or water-soluble halide to a reaction vessel, the foregoing compounds may be allowed to exist therein. The compound may be mixed with a halide solution and added together with the halide. The compound may be added separately from the water-soluble silver salt and halide.

There may also be used oxidizing agents for the purpose of deactivating the reducing agent. Examples of such oxidizing agents include (aqueous) hydrogen peroxide and its adduct (e.g., $H_2O_2$, $NaBO_2.H_2O_2.3H_2O$, $2Na_2CO_3.3H_2O_2$. $Na_4P_2O_7.2H_2O_2$, $2Na_2SO_4.H_2O_2.2H_2O$), peroxyacid salts (e.g., $K_2S_2O_8$, $K_2C_2O_6$, $K_2P_2O_8$), peroxy complex compound {e.g., $K_2[Ti(O_2)C_2O_4].3H_2O$,}, peracetic acid, ozone, $I_2$ and thiosulfonates. The oxidizing agents may be used for the purpose other than deactivating the reducing agent. The oxidizing agent may be added in any amount, depending on the kind of the reducing agent, reduction sensitization conditions, addition time and conditions of the oxidizing agent. The oxidizing agent may be added prior to addition of the reducing agent. The oxidizing agent may be added in a manner similar to conventional additives. For example, the oxidizing agent is added in solution in organic solvents such as alcohols or water.

After addition of the oxidizing agent, a reducing agent is newly added to neutralize the excessive oxidizing agent. Such a reducing agent is a substance capable of reducing the oxidizing agent, and examples thereof include sulfonic acids, di- and tri-hydroxybenzenes, chromans, hydrazins and hydrazides, p-phenylenediamines, aldehydes, aminophenols, ene-diols, oximes, reductones, phenidones, sulfites and ascorbic acid derivatives.

In this invention, there can be used a silver halide emulsion containing silver halide grains having silver halide protrusions on the grain surface. The silver halide emulsion containing silver halide grains having silver halide protrusions on the grain surface refers to a silver halide emulsion in which the silver halide grains having silver halide protrusions on the grain surface account for at least 30%, preferably at least 50%, and more preferably at least 70% of the total grain projected area.

In the silver halide emulsion containing silver halide grains having silver halide protrusions on the grain surface, the silver halide protrusions on the grain surface preferably are epitaxial. It is generally supposed that epitaxially arranging silver halide protrusions at a selected site on a silver halide grain as a substrate (hereinafter, also called host grain) reduces competition of conduction band electrons ejected by absorption of photons upon imagewise exposure to sensitizing sites, thereby enhancing sensitivity. U.S. Pat. No. 4,435,501 discloses epitaxially adhering a silver salt onto a selected site on the surface of a tabular silver halide grain, thereby achieving enhanced sensitivity. This U.S. Patent describes that enhanced sensitivity is attributed to epitaxial adhesion of the silver salt being limited to a small area portion on the surface of the tabular grain. Thus, an epitaxial arrangement limited to a specific portion within the major face of the tabular grain is effective for epitaxial arrangement covering overall the major face, an epitaxial arrangement substantially limited to edge portions of the host grain, thereby limiting coverage on the major face is preferred; and an epitaxial arrangement limited to corners or vicinity thereof, or a separate portion is more effective and preferred. Spacing between corners of the host grain reduces competition of photoelectrons to an extent capable of achieving the maximum sensitivity. U.S. Pat. No. 4,435,501 teaches retarding epitaxial adhesion reduces the number of epitaxially arranged sites.

In this invention, it is preferred to limit the epitaxially arranged silver halide protrusions to a small portion on the surface of the host grain and it is more preferred to limit the protrusions to corners or neighbors thereof. Specifically, less than 50% is preferred and less than 30% is more preferred. The silver amount of the epitaxially arranged silver halide protrusions preferably is 0.3 to 25%, and more preferably 0.5 to 15%.

In one specifically preferred embodiment of employing a silver halide emulsion containing silver halide grains having silver halide protrusions on the grain surface, the epitaxially arranged silver halide protrusions are limited to corners or neighbors of the corners in the host grain, and commonly known methods are applicable to achieve this. U.S. Pat. No. 4,435,501 discloses a technique of allowing spectral sensitizing dyes or aminoazaindenes to be adsorbed as a site director, which is preferably applicable to this invention.

To avoid structural breakdown of the host grain, the total solubility of the epitaxially arranged silver halide protrusions preferably is higher that that of the silver halide host grain. Accordingly, the epitaxially arranged silver halide protrusions are preferably silver chloride. Silver chloride forms a face-centered cubic lattice similar to silver bromide, making it easier to be epitaxially adhered.

To maintain structural consistency of the host grain, epitaxial adhesion is preferably performed under conditions of restraining solubility of a halide forming the host grain. However, in one case, halide composition of the epitaxially arranged silver halide protrusions is the same as that of the host grain. Thus, silver chloride protrusions contain a small amount of bromide or iodide.

In the preparation of silver halide emulsion relating to the invention, various methods are applicable to the formation of silver halide grains. Thus, single jet addition, double jet addition, triple jet addition or fine silver halide grain-supplying method is usable singly or in combination. A technique of controlling the pH and pAg in a liquid phase forming silver halide along with the grain growth rate may be applied in combination. The grain formation is preferably carried out under the condition close to critical grain growth rate.

A seed grain emulsion may be used in the preparation of silver halide emulsions relating to the invention. Silver halide grains contained in the seed emulsion may be those having a regular crystal structure, such as cubic, octahedral or tetradecahedral grains or those having an irregular crystal structure such as spherical or tabular grains. These grains may have any proportion of (100) face and (111) face. The seed grains may be composite of these crystal forms or a mixture of various crystal form grains. Specifically, silver halide grains contained in the seed emulsion preferably are twinned crystal grains, and more preferably twinned crystal grains having two parallel twin planes.

In any case of using the seed emulsion or using no seed emulsion, commonly known methods are applicable as conditions for nucleation and ripening of silver halide grains. Silver halide solvents known in the art may be used in the preparation of silver halide emulsions but it is preferred to avoid the use of such silver halide solvents in the formation of tabular substrate grains, except for at ripening after nucleation.

Any of the acidic precipitation process, neutral precipitation process or ammoniacal precipitation process is applicable to the preparation of silver halide emulsions relating to the invention, and the acidic or neutral precipitation process is preferred. Halide and silver ions may be simultaneously mixed or either one of them may be added into the other one. Taking account of critical growth rate of silver halide crystals, halide and silver ions may be sequentially or simultaneously added, while controlling the pAg and pH within the vessel. Halide conversion may be applied at any stage in the silver halide to vary halide composition.

In cases where fine silver halide grains are used in the invention, the fine silver halide grains may be prepared in advance to or concurrently to the preparation of silver halide grains relating to the invention. In the latter concurrent preparation, as described in JP-A 1-183417 and 2-44335, the fine silver halide grains can be prepared using a mixer separately provided outside the reaction vessel for preparing the silver halide grains relating to the invention. It is preferred that a preparation vessel is separately provided from the mixer and fine silver halide grains which have been prepared in the mixer are optimally prepared in the preparation vessel so as to fit the growth environment within the reaction vessel for preparing the silver halide grains relating to the invention, thereafter, the fine silver halide grains are supplied to the reaction vessel. In cases when reduction-sensitized fine grains are not intended, the fine grains are preferably prepared in an acidic or neutral environment (at a pH$\leqq$7). In cases when intending the reduction-sensitized fine grains, the fine grains can be prepared by combining means for reduction sensitization. The fine silver halide grains can be prepared by mixing an aqueous silver ion solution and aqueous halide ion solution while optimally controlling super-saturation factors. Control of super-saturation factors can be carried out with reference to the teaching of JP-A 63-92942 and 63-311244.

The fine silver halide grains are preferably prepared at a pAg of not less than 3.0, more preferably not less than 5.0, and still more preferably not less than 8.0 to inhibit production of reduced silver nuclei. The fine silver halide grains are also preferably prepared at a temperature of not higher than 50° C., more preferably not higher than 40° C., and still more preferably not higher than 35° C. Protective colloids used for preparation of the fine silver halide grains are the same as used in the preparation of silver halide grains mentioned earlier.

Forming fine silver halide grains at a relatively low temperature retards an increase in size of the fine grains due to Ostwald ripening after formation of the fine grain. However, gelatin tends to coagulate at a low temperature, so that it is preferred to use a low molecular weight gelatin described in JP-A No. 2-166422, synthetic molecular compounds or natural polymeric compounds other than gelatin. The protective colloid concentration preferably is not less than 1%, more preferably not less than 2%, and still more preferably not less than 3% by weight. The fine grain size preferably is not more than 0.1 $\mu$m, and more preferably not more than 0.05 $\mu$m. The fine silver halide grains may optionally be reduction-sensitized or be occluded with metal ions.

In the manufacture of silver halide emulsions relating to this invention, a concentration operation is preferably conducted by means of ultrafiltration at the stage of at least a part of the grain growth process. Specifically, preparation of a silver halide emulsion comprising tabular grains having a relatively high aspect ratio is performed preferably in a diluted environment so that application of the ultrafiltration is preferred to enhance the manufacturing efficiency. When conducting concentration of silver halide emulsion by ultrafiltration in the process of preparation of silver halide emulsion relating to the invention, a manufacturing installation of silver halide emulsions described in JP-A 10-339923 is preferably employed.

The concentration mechanism is connected via pipes to the reaction vessel, in which the reaction mixture solution can be circulated at an intended rate between the reaction vessel and the concentration mechanism by means of a circulation mechanism such as a pump. The facility may further be installed with an apparatus for detecting the volume of a salt containing solution extracted from the reaction mixture solution through the concentration mechanism, having a mechanism capable of controlling the volume at the intended level. There can optionally be provided other function(s).

The concentration by means of ultrafiltration is applied in the form of the following (1) or (2), or their combination:

(1) using the concentration mechanism described above, the volume of a reaction mixture solution is reduced during the process of forming silver halide grains;

(2) using the concentration mechanism described above, an aqueous solution containing soluble material is removed during the process of forming silver halide grains, in an amount equivalent to or less than that of solution added for silver halide grain formation to maintain the reaction mixture solution at a substantially constant level or to restrain an increase of the reaction solution volume.

It is preferred to reduce the reaction solution volume by the foregoing method (1) prior to introducing dislocation lines to enhance the proportion of grains containing dislocation lines.

The ultrafiltration may be conducted at any time during the process of forming silver halide grains with interrupting silver halide grain growth or concurrently with continuing the silver halide grain growth. The ultrafiltration may be conducted plural time during the grain formation process, and is performed preferably before completion of silver halide grain formation, and more preferably during silver halide grain growth.

Employing the ultrafiltration, unwanted soluble salts can be removed in the process of forming silver halide grains. There is also feasible removal or deactivation of unreacted reactants or undoped residues of compounds added during the grain formation, including a reducing agent, oxidizing agent, halogen ion releasing compound, silver halide solvent, polyvalent metal, polyvalent metal ion, polyvalent metal complex, polyvalent metal ion complex, and the like. It is also possible to perform control of silver halide grain growth conditions, for example, control of the distance between grains and control of a pH or a pBr for silver halide grain growth, control of the reaction solution volume and concentration thereof.

Ultrafiltration employing membrane separation is described in "Kagakukogaku Binran 5th Ed." (Handbook of Chemical Engineering, edited by Kagakukogaku Kyokai, Maruzen) page 924–954; RD vol. 102, item 10208, ibid vol. 131, item 13122; JP-B Nos. 59-43727 and 62-27008; JP-A Nos. 62-113137, 57-209823, 59-43727, 62-113137, 61-219948, 62-23035, 63-40137, 63-40039, 3-140946, 2-172816, 2-172817, and 4-22942. Apparatuses or methods described in JP-A 11-339923 and 11-231448 are also usable in this invention.

In the silver halide emulsion making of the invention, after completion of silver halide grain growth, soluble salts are preferably removed. Soluble salts can be removed in accordance with methods described in RD17643, item II. Thus, to remove soluble salts from the emulsion after forming precipitates or completing physical ripening, there may be employed a noodle washing method by chill-setting gelatin or a coagulation washing (flocculation) by using inorganic salts, anionic surfactants, anionic polymers (e.g., polystyrene sulfonic acid, etc.) or gelatin derivatives (e.g., acylated gelatin, carbamoylated gelatin, etc.). Ultrafiltration employing the foregoing membrane separation is also preferably employed for desalting.

In the nucleation and/or grain growth using fine silver halide grains in the silver halide emulsion relating to this invention, it is preferred to perform the nucleation and/or grain growth described above using a mixer provided outside a reaction vessel. The mixer provided outside the reaction vessel preferably is a continuous nucleation equipment, in which nuclei or fine silver halide grains are continuously formed and continuously supplied to the reaction vessel. The continuous nucleation equipment is described in JP-A No. 2000-112049.

Manufacture of silver halide emulsions relating to this invention is described in JP-A Nos. 61-6643, 61-14630, 61-112142, 62-157024, 62-18556, 63-92942, 63-151618, 63-163451, 63-220238, 63-311244; RD38957 sect. I and III, RD40145 sect. XV.

In cases when constituting a color photographic material using silver halide emulsions according to the invention are employed silver halide emulsions according to the invention, which have been subjected to physical ripening, chemical sensitization and spectral sensitization. Additives used in such a process are described in RD38957, Sect. IV and V, RD40145, Sect. XV. Commonly known photographic additives usable in the invention are also describe din RD 38957, Sect. II to X and RD 40145, Sect. I to XIII.

Silver halide photographic materials relating to the invention may be provided with red-, green- and blue-sensitive silver halide emulsion layers, each of which may each preferably exhibit an absorption maximum farther by at least 20 nm the other dyes. The use of a cyan coupler, magenta coupler and yellow coupler is preferred as a coupler. The combination with a coupler and an emulsion layer is preferably the combination of a yellow coupler and a blue-sensitive layer, that of a magenta coupler and a green-sensitive layer, and that of a cyan coupler and a red-sensitive layer, but is not limited to these combinations and other combinations may be acceptable.

DIR compounds may be used in the invention. Examples of DIR compounds usable in the invention include those described in JP-A 4-114153, D-1 through D-34. These compounds are preferably used in the invention. Further, examples of usable DIR compounds include those described in U.S. Pat. Nos. 4,234,678, 3,227,554, 3,647,291, 3,958, 993, 4,419,886, 3,933,500; JP-A 57-56837, 51-13239; U.S. Pat. No. 2,072,363, 2,070,266; and RD 40145, Sect. XIV.

Exemplary examples of couplers usable in the invention are those described in RD 40145, Sect. II. Additives used in the invention can be incorporated using a dispersing method described in RD 40145, Sect. VIII. Commonly known supports, as described in RD 38957, Sect. XV are also usable in the invention. Auxiliary layers such as a filter layer or interlayer, as described din RD 38957, Sect. XI may be provided in photographic materials relating to the invention. Photographic materials can have various layer arrangements such as convention layer order, reverse order and unit constitution, as described in RD 38957, Sect. XI.

Silver halide emulsions according to the invention can be applied to various color photographic materials, such as color negative films used for general purpose or cine films, color reversal films for reversal or television, color paper, color positive films, color reversal paper.

Photographic materials relating to the invention can be processed using commonly known developers describe in T.

H. James, The Theory of The Photographic Process, Forth Edition, pages 291 to 334; J. Am. Chem. Soc. 73, 3100 (1951), in accordance with the conventional process, as described in RD 38957, Sect. XVII to XX, and RD 40145, Sect. XXIII.

EXAMPLES

The present invention will be further described based on examples, but embodiments of the invention are by no means limited to these.

Example 1

Preparation of Tabular Seed Emulsion T-A1

In accordance with the following procedure, tabular seed emulsion T-A1 was prepared.

Nucleation Process

A 10.47 lit. aqueous solution containing 70.7 g of oxidized gelatin A (methionine content of 0.3 μmol/g) and 12.3 g of potassium bromide was maintained at 20° C. in a reaction vessel and adjusted to a pH of 1.90 using an aqueous 0.5 mol/l sulfuric acid solution, while stirring at a high speed using a mixing stirrer, as described in JP-A No. 62-160128. Thereafter, the following solutions, S-01 and X-01 were added by double jet addition in one minute to perform nucleation and then, solution G-01 was further added thereto.

S-01 Solution: 88.75 ml of 1.25 mol/l aqueous silver nitrate solution,

X-01 Solution: 88.75 ml of 1.25 mol/l aqueous potassium bromide solution,

G-01 Solution: 1260 ml of aqueous solution containing 52.0 g of gelatin A and 3.78 ml of a 10% methanol solution of surfactant (EO-1).

Surfactant EO-1: $HO(CH_2CH_2O)m[CH(CH_3)CH_2O]_{19.8}(CH_2CH_2O)nH$ (m+n=9.77)

Ripening Process

After completion of the nucleation process, the temperature was raised to 60° C. in 70 min. and then, the pAg was adjusted to 8.8 using a 1.75 mol/l aqueous potassium bromide solution, and after adding 96.8 ml of an aqueous solution containing 9.68 g of ammonium nitrate, 285 ml of a 10% aqueous potassium hydroxide solution was added and maintained for 6 min. 30 sec. Then, the reaction mixture was adjusted to a pH of 7.6 with a 56% aqueous acetic solution.

Growth Process

After completion of the ripening process, the pAg was adjusted to 8.8 with a 1.75 mol/l aqueous potassium bromide solution, and then, solutions S-02 and X-02 were added by double jet addition at an accelerated flow rate for 8 min., while maintaining the pH at 6.1 with a 56% aqueous acetic acid solution.

S-02 Solution: 1130 ml of 1.25 mol/l aqueous silver nitrate solution,

X-02 Solution: 1130 ml of 1.25 mol/l aqueous potassium bromide solution.

After completion of addition of respective solutions, the resulting emulsion was desalted by using an aqueous Demol (produced by Kao-Atlas) and an aqueous magnesium sulfate solution, and alkali-processed inert gelatin B (methionine content of 50.0 μmol/g) was added thereto and dispersed. The thus obtained emulsion was denoted as seed emulsion T-A1.

The tabular seed grain emulsion T-A1 was comprised of tabular grains, and it was proved that 50% of the total grain projected area was accounted for tabular grains having an aspect ratio of at least 14, an average aspect ratio of 13, an average equivalent circle diameter of 0.65 μm, a coefficient of variation of equivalent circle diameter of 30%, an average grain thickness of 0.05 μm and an average spacing between twin planes of 110 A. It was further proved that 88% by number of the grains was accounted for by tabular grains having two twin planes parallel to the major faces.

Preparation of Tabular Silver Halide Grain Emulsion Em-1

Subsequently, the foregoing tabular seed emulsion T-A1 was grown in accordance with the following procedure to prepare tabular grain emulsion Em-1, in which the mixing stirrer, as described in JP-A No. 62-160128 was used, and to remove soluble components from the reaction mixture by means of ultrafiltration was employed an apparatus described in JP-A No. 10-339923. Thus, to an aqueous 1% gelatin solution containing 0.411 mol. equivalent tabular seed emulsion T-A1 and 0.12 ml of a 10% methanol solution of the foregoing surfactant EO-1, water and 285.4 g of gelatin B were added to make 29.9 lit., then, the following solutions S-11 and X-11 were added by double jet addition at an accelerated flow rate over a period of 86 min. with maintaining the pAg at 9.4 with a 1.75 mol/l aqueous potassium bromide solution and a temperature of 60° C., while soluble components in the reaction mixture were removed by ultrafiltration to maintain the reaction mixture at a constant volume.

S-11 Solution: 7538 ml of 1.75 mol/l aqueous silver nitrate solution,

X-11 Solution: 7538 ml of 1.741 mol/l potassium bromide and 0.009 mol/l potassium iodide aqueous solution.

The reaction mixture was further subjected to ultrafiltration over a period of 30 min. to remove 12.0 lit. of soluble components from the reaction mixture. Thereafter, the following solution S-12 was added thereto at a decreasing rate over a period of 16 min. and the pAg was adjusted to 8.6.

S-12 Solution: 727 ml of 1.75 mol/l aqueous silver nitrate solution

Subsequently, solutions I-11 and Z-11 were added and after adjusting to a pH of 9.3 and being maintained for 6 min., the pH was adjusted to 5.0 with an aqueous acetic acid solution and the pAg was adjusted to 9.4 with an aqueous 1.75 mol/l potassium bromide solution:

I-11 Solution: 806 ml of aqueous solution containing 100.0 g of sodium p-iodoacetoamido-benzene-sulfonate, Z-11 Solution: 358 ml of aqueous solution containing 34.7 g of sodium sulfite.

Then, the following solutions S-13 and X-13 were added at an accelerated flow rate over a period of 16 min, while soluble components in the reaction mixture were removed by ultrafiltration to maintain the reaction mixture at a constant volume. During the addition, the pH was adjusted to 5.0 with a 56% aqueous acetic acid solution and the pAg was adjusted to 9.4 with a 1.75 mol/l potassium bromide solution.

S-13 Solution: 1090 ml of aqueous 1.75 mol/l silver nitrate solution,

X-13 Solution: 1090 ml of aqueous 1.663 mol/l potassium bromide and 0.088 mol/l potassium iodide solution.

Subsequently, the following solution S-14 was added thereto at a decreasing rate over a period of 15 min., thereafter, the pAg was adjusted to 8.4.

S-14 Solution: 727 ml of 1.75 mol/l aqueous silver nitrate solution

Further subsequently, the following solutions S-15 and X-15 were added by double jet addition at an accelerated flow rate over a period of 24 min., while the pH was maintained at 5.0 with a 56% aqueous acetic acid solution and the pAg was maintained at 8.4 with a 1.75 mol/l potassium bromide solution. Thereafter, the pAg was adjusted to 9.4 with an aqueous potassium bromide solution.

Then, the following solutions S-16 and X-16 were added by double jet addition at an accelerated flow rate over a period of 17 min., while soluble components in the reaction mixture were removed by ultrafiltration to maintain the reaction mixture at a constant volume. During the addition, the pH was adjusted to 5.0 with a 56% aqueous acetic acid solution and the pAg was adjusted to 9.4 with a 1.75 mol/l potassium bromide solution.

S-15 Solution: 605 ml of aqueous 1.75 mol/l silver nitrate solution,

X-15 Solution: 605 ml of aqueous 1.663 mol/l potassium bromide and 0.088 mol/l potassium iodide solution.

S-16 Solution: 1211 ml of aqueous 1.75 mol/l silver nitrate solution,

X-16 Solution: 1211 ml of aqueous 1.75 mol/l potassium bromide solution.

After completion of addition, aqueous solution containing 360 g of chemically modified gelatin (in which the amino group was phenylcarbamoyled at a modification percentage of 95%) was added to perform desalting and washing, and then gelatin was further added and dispersed, followed by adjusting the pH and pAg to 5.8 and 8.9, respectively, at 40° C.

Tabular silver halide grain emulsion Em-1 (hereinafter, also denoted simply as emulsion Em-1) was thus obtained. Analysis of emulsion Em-1 revealed that at least 95% of the total grain projection area was accounted for by tabular grains having an average aspect ratio of 20 and an average equivalent circle diameter of 3.0 μm, a coefficient of variation of equivalent circle diameter of 37%, an average grain thickness of 0.15 μm and an average spacing between twin planes of 110 A, and 90% by number of the grain was accounted for by tabular grains having two twin planes parallel to the major faces. It was also proved that 83% by number of the grain was accounted for by hexagonal tabular silver halide grains, in which 65% by number was accounted for by hexagonal grains having an adjacent edge ratio of not less than 1.0 and less than 1.2, and 55% by number was accounted for by hexagonal grains having an adjacent edge ratio of not less than 1.0 and less than 1.1. It was further proved that 74% by number of the tabular silver halide grains contained dislocation lines, of which 38% by number contained dislocation lines in the fringe portions and the major faces, 52% by number contained at least 10 dislocation lines in the fringe portions and 32% by number contained at least 30 dislocation lines in the fringe portions. It was further proved that silver halide grains contained in the tabular silver halide emulsion Em-1 had an average overall iodide content of 2.3 mol % and an average surface iodide content of 6.7 mol %; a coefficient of variation of spacing between twin planes was 31%, a coefficient of variation of grain thickness was 32%, the proportion of (100) face of the total surfaces of the tabular grains was 30%, the proportion of heteromorphic grains was 7.0% by number and the proportion of heteromorphic twinned grains was 5.5% by number.

Preparation of Tabular Seed Emulsion T-A2

In accordance with the following procedure, tabular seed emulsion T-A2 was prepared.

Nucleation Process

A 10.47 lit. aqueous solution containing 70.7 g of oxidized gelatin A (methionine content of 0.3 μmol/g) and 12.3 g of potassium bromide was maintained at 20° C. in a reaction vessel and adjusted to a pH of 1.90 using an aqueous 0.5 mol/l sulfuric acid solution, while stirring at a high speed using a mixing stirrer, as described in JP-A No. 62-160128. Thereafter, the following solutions, S-01a and X-01a were added by double jet addition in one minute to perform nucleation and then, solution G-01a was further added thereto.

S-01a Solution: 88.75 ml of 1.25 mol/l aqueous silver nitrate solution,

X-01a Solution: 88.75 ml of 1.25 mol/l aqueous potassium bromide solution,

G-01a Solution: 1260 ml of aqueous solution containing 52.0 g of gelatin A and 3.78 ml of a 10% methanol solution of surfactant (EO-1).

Ripening Process

After completion of the nucleation process, the temperature was raised to 75° C. in 73 min. and then, the pAg was adjusted to 8.7 using a 1.75 mol/l aqueous potassium bromide solution in 45 min. from the start of raising the temperature, and after adding 96.8 ml of an aqueous solution containing 9.68 g of ammonium nitrate at 45 min. from the start of raising the temperature, 285 ml of a 10% aqueous potassium hydroxide solution was added and maintained for 6 min. 30 sec. Then, the reaction mixture was adjusted to a pH of 7.6 with a 56% aqueous acetic solution.

Growth Process

After completion of the ripening process, the pAg was adjusted to 8.7 with a 1.75 mol/l aqueous potassium bromide solution, and then; solutions S-02a and X-02a were added by double jet addition at an accelerated flow rate for 8 min., while maintaining the pH at 6.1 with a 56% aqueous acetic acid solution.

S-02a Solution: 1130 ml of 1.25 mol/l aqueous silver nitrate solution,

X-02a Solution: 1130 ml of 1.25 mol/l aqueous potassium bromide solution.

After completion of addition of respective solutions, the resulting emulsion was desalted by using an aqueous Demol (produced by Kao-Atlas) and an aqueous magnesium sulfate solution, and alkali-processed inert gelatin B (methionine content of 50.0 μmol/g) was added thereto and dispersed. The thus obtained emulsion was denoted as seed emulsion T-A2.

The tabular seed grain emulsion T-A2 was comprised of tabular grains, and it was proved that 50% of the total grain projected area was accounted for tabular grains having an aspect ratio of at least 14, an average aspect ratio of 13, an average equivalent circle diameter of 0.65 μm, a coefficient of variation of equivalent circle diameter of 25%, an average grain thickness of 0.05 μm and an average spacing between twin planes of 110 A. It was further proved that 93% by number of the grains was accounted for by tabular grains having two twin planes parallel to the major faces.

Preparation of Tabular Silver Halide Grain Emulsion Em-2

Tabular silver halide grain emulsion Em-2 was prepared similarly to the foregoing emulsion Em-1, except that the tabular seed grain emulsion T-A1 was replaced by seed grain emulsion T-A2.

Analysis of emulsion Em-2 revealed that at least 95% of the total grain projection area was accounted for by tabular grains having an average aspect ratio of 20 and an average equivalent circle diameter of 3.0 μm, a coefficient of variation of equivalent circle diameter of 34%, an average grain thickness of 0.15 μm and an average spacing between twin planes of 110 A, and 92% by number of the grain was accounted for by tabular grains having two twin planes parallel to the major faces. It was also proved that 90% by number of the grain was accounted for by hexagonal tabular silver halide grains, in which 83% by number was accounted for by hexagonal grains having an adjacent edge ratio of not less than 1.0 and less than 1.2, and 70% by number was accounted for by hexagonal grains having an adjacent edge ratio of not less than 1.0 and less than 1.1. It was further proved that 76% by number of the tabular silver halide grains contained dislocation lines, of which 38% by number contained dislocation lines in the fringe portions and the major faces, 55% by number contained at least 10 dislocation lines in the fringe portions and 34% by number contained at least 30 dislocation lines in the fringe portions. It was further proved that silver halide grains contained in the tabular silver halide emulsion Em-2 had an average overall iodide content of 2.3 mol % and an average surface iodide content of 6.6 mol %; a coefficient of variation of spacing between twin planes was 31%, a coefficient of variation of grain thickness was 30%, the proportion of (100) face of the total surfaces of the tabular grains was 32%, the proportion of heteromorphic grains was 5.8% by number and the proportion of heteromorphic twinned grains was 4.0% by number.

Preparation of Tabular Seed Emulsion T-A3

In accordance with the following procedure, tabular seed emulsion T-A3 was prepared.

Nucleation Process

A 10.47 lit. aqueous solution containing 70.7 g of oxidized gelatin A (methionine content of 0.3 μmol/g) and 12.3 g of potassium bromide was maintained at 20° C. in a reaction vessel and adjusted to a pH of 1.90 using an aqueous 0.5 mol/l sulfuric acid solution, while stirring at a high speed using a mixing stirrer, as described in JP-A No. 62-160128. Thereafter, the following solutions, S-01b and X-01b were added by double jet addition in one minute to perform nucleation and then, solution G-01b was further added thereto.

S-01b Solution: 88.75 ml of 1.25 mol/l aqueous silver nitrate solution,

X-01b Solution: 88.75 ml of 1.25 mol/l aqueous potassium bromide solution,

G-01b Solution: 1260 ml of aqueous solution containing 52.0 g of gelatin A and 3.78 ml of a 10% methanol solution of surfactant (EO-1).

Ripening Process

After completion of the nucleation process, the temperature was raised to 75° C. in 45 min. and then, the pAg was adjusted to 8.6 using a 1.75 mol/l aqueous potassium bromide solution in 30 min. from the start of raising the temperature, and after adding 96.8 ml of an aqueous solution containing 9.68 g of ammonium nitrate at 35 min. from the start of raising the temperature, 285 ml of a 10% aqueous potassium hydroxide solution was added and maintained for 6 min. 30 sec. Then, the reaction mixture was adjusted to a pH of 7.6 with a 56% aqueous acetic solution.

Growth Process

After completion of the ripening process, the pAg was adjusted to 8.6 with a 1.75 mol/l aqueous potassium bromide solution, and then, solutions S-02b and X-02b were added by double jet addition at an accelerated flow rate for 8 min., while maintaining the pH at 6.1 with a 56% aqueous acetic acid solution.

S-02b Solution: 1130 ml of 1.25 mol/l aqueous silver nitrate solution,

X-02b Solution: 1130 ml of 1.25 mol/l aqueous potassium bromide solution.

After completion of addition of respective solutions, the resulting emulsion was desalted by using an aqueous Demol (produced by Kao-Atlas) and an aqueous magnesium sulfate solution, and alkali-processed inert gelatin B (methionine content of 50.0 μmol/g) was added thereto and dispersed. The thus obtained emulsion was denoted as seed emulsion T-A3.

The tabular seed grain emulsion T-A3 was comprised of tabular grains, and it was proved that 50% of the total grain projected area was accounted for tabular grains having an aspect ratio of at least 14, an average aspect ratio of 13, an average equivalent circle diameter of 0.67 μm, a coefficient of variation of equivalent circle diameter of 22%, an average grain thickness of 0.05 μm and an average spacing between twin planes of 110 A. It was further proved that 95% by number of the grains was accounted for by tabular grains having two twin planes parallel to the major faces.

Preparation of Tabular Silver Halide Grain Emulsion Em-3

Tabular silver halide grain emulsion Em-3 was prepared similarly to the foregoing emulsion Em-1, except that the tabular seed grain emulsion T-A1 was replaced by seed grain emulsion T-A3.

Analysis of emulsion Em-3 revealed that at least 95% of the total grain projection area was accounted for by tabular grains having an average aspect ratio of 20 and an average equivalent circle diameter of 3.0 μm, a coefficient of variation of equivalent circle diameter of 29%, an average grain thickness of 0.15 μm and an average spacing between twin planes of 110 A, and 95% by number of the grain was accounted for by tabular grains having two twin planes parallel to the major faces. It was also proved that 93% by number of the grain was accounted for by hexagonal tabular silver halide grains, in which 87% by number was accounted for by hexagonal grains having an adjacent edge ratio of not less than 1.0 and less than 1.2, and 74% by number was accounted for by hexagonal grains having an adjacent edge ratio of not less than 1.0 and less than 1.1. It was further proved that 78% by number of the tabular silver halide grains contained dislocation lines, of which 39% by number contained dislocation lines in the fringe portions and the major faces, 54% by number contained at least 10 dislocation lines in the fringe portions and 36% by number contained at least 30 dislocation lines in the fringe portions. It was further proved that silver halide grains contained in the tabular silver halide emulsion Em-3 had an average overall iodide content of 2.3 mol % and an average surface iodide content of 6.7 mol %; a coefficient of variation of spacing between twin planes was 26%, a coefficient of variation of grain thickness was 25%, the proportion of (100) face of the total surfaces of the tabular grains was 33%, the proportion of heteromorphic grains was 2.8% by number and the proportion of heteromorphic twinned grains was 2.5% by number.

Preparation of Tabular Silver Halide Grain Emulsion Em-4

Tabular silver halide grain emulsion Em-4 was prepared similarly to the foregoing emulsion Em-3, except that solutions I-11 and Z-11 were replaced by the following solution I-11a and Z-11a:

I-11a Solution: 1550 ml of aqueous solution containing 192.3 g of sodium p-iodoacetoamido-benzenesulfonate, Z-11a Solution: 688 ml of aqueous solution containing 66.7 g of sodium sulfite.

Analysis of emulsion Em-4 revealed that at least 95% of the total grain projection area was accounted for by tabular grains having an average aspect ratio of 20 and an average equivalent circle diameter of 3.0 μm, a coefficient of variation of equivalent circle diameter of 29%, an average grain thickness of 0.15 μm and an average spacing between twin planes of 110 A, and 95% by number of the grain was accounted for by tabular grains having two twin planes parallel to the major faces. It was also proved that 93% by number of the grain was accounted for by hexagonal tabular silver halide grains, in which 87% by number was accounted for by hexagonal grains having an adjacent edge ratio of not less than 1.0 and less than 1.2, and 74% by number was accounted for by hexagonal grains having an adjacent edge ratio of not less than 1.0 and less than 1.1. It was further proved that 96% by number of the tabular silver halide grains contained dislocation lines, of which 88% by number contained dislocation lines in the fringe portions and the major faces, 93% by number contained at least 10 dislocation line in the fringe portions and 72% by number contained at least 30 dislocation lines in the fringe portions. It was further proved that silver halide grains contained in the tabular silver halide emulsion Em-4 had an average overall iodide content of 3.5 mol % and an average surface iodide content of 8.3 mol %; a coefficient of variation of spacing between twin planes was 26%, a coefficient of variation of grain thickness was 25%, the proportion of (100) face of the total surfaces of the tabular grains was 31%, the proportion of heteromorphic grains was 2.5% by number and the proportion of heteromorphic twinned grains was 2.0% by number.

Preparation of Tabular Silver Halide Grain Emulsion Em-5

Tabular silver halide grain emulsion Em-5 was prepared similarly to the foregoing emulsion Em-4, except that the amount of a 10% methanol solution of the foregoing surfactant EO-1 was 0.08 ml, the reaction mother liquor was varied to 35.9 lit. by adding water, solutions S-11 and S-11 were added with maintaining the pAg at 9.2, and after completion of the addition of solutions S-11 and S-11, the reaction mixture solution was subjected to ultrafiltration for 30 min. to remove 20 lit. of liquid containing soluble components.

Analysis of emulsion Em-5 revealed that at least 95% of the total grain projection area was accounted for by tabular grains having an average aspect ratio of 23 and an average equivalent circle diameter of 3.2 μm, a coefficient of variation of equivalent circle diameter of 22%, an average grain thickness of 0.14 μm and an average spacing between twin planes of 110 A, and 95% by number of the grain was accounted for by tabular grains having two twin planes parallel to the major faces. It was also proved that 93% by number of the grain was accounted for by hexagonal tabular silver halide grains, in which 93% by number was accounted for by hexagonal grains having an adjacent edge ratio of not less than 1.0 and less than 1.2, and 86% by number was accounted for by hexagonal grains having an adjacent edge ratio of not less than 1.0 and less than 1.1. It was further proved that 95% by number of the tabular silver halide grains contained dislocation lines, of which 89% by number contained dislocation lines in the fringe portions and the major faces, 92% by number contained at least 10 dislocation line in the fringe portions and 74% by number contained at least 30 dislocation lines in the fringe portions. It was further proved that silver halide grains contained in the tabular silver halide emulsion Em-5 had an average overall iodide content of 3.5 mol % and an average surface iodide content of 8.2 mol %; a coefficient of variation of spacing between twin planes was 25%, a coefficient of variation of grain thickness was 22%, the proportion of (100) face of the total surfaces of the tabular grains was 30%, the proportion of heteromorphic grains was 0.8% by number and the proportion of heteromorphic twinned grains was 0.7% by number.

Preparation of Tabular Seed Emulsion T-A4

In accordance with the following procedure, tabular seed emulsion T-A4 was prepared.

Nucleation Process

A 13.6 lit. aqueous solution containing 91.9 g of oxidized gelatin B (methionine content of 0.1 μmol/g) and 16.0 g of potassium bromide was maintained at 20° C. in a reaction vessel and adjusted to a pH of 1.90 using an aqueous 0.5 mol/l sulfuric acid solution, while stirring at a high speed using a mixing stirrer, as described in JP-A No. 62-160128. Thereafter, the following solutions, S-01c and X-01c were added by double jet addition in one minute to perform nucleation and then, solution G-01c was further added thereto.

S-01c Solution: 88.75 ml of 1.25 mol/l aqueous silver nitrate solution,

X-01c Solution: 88.75 ml of 1.25 mol/l aqueous potassium bromide solution,

G-01c Solution: 1640 ml of aqueous solution containing 67.6 g of oxidized gelatin B and 3.78 ml of a 10% methanol solution of surfactant (EO-1).

Ripening Process

After completion of the nucleation process, the temperature was raised to 75° C. in 45 min. and then, the pAg was adjusted to 8.6 using a 1.75 mol/l aqueous potassium bromide solution in 30 min. from the start of raising the temperature, and after adding 96.8 ml of an aqueous solution containing 9.68 g of ammonium nitrate at 35 min. from the start of raising the temperature, 285 ml of a 10% aqueous potassium hydroxide solution was added and maintained for 6 min. 30 sec. Then, the reaction mixture was adjusted to a pH of 7.6 with a 56% aqueous acetic solution.

Growth Process

After completion of the ripening process, the pAg was adjusted to 8.6 with a 1.75 mol/l aqueous potassium bromide solution, and then, solutions S-02c and X-02c were added by double jet addition at an accelerated flow rate for 8 min., while maintaining the pH at 6.1 with a 56% aqueous acetic acid solution.

S-02c Solution: 1130 ml of 1.25 mol/l aqueous silver nitrate solution,

X-02c Solution: 1130 ml of 1.25 mol/l aqueous potassium bromide solution.

After completion of addition of respective solutions, the resulting emulsion was desalted by using an aqueous Demol (produced by Kao-Atlas) and an aqueous magnesium sulfate solution, and alkali-processed inert gelatin B (methionine content of 50.0 μmol/g) was added thereto and dispersed. The thus obtained emulsion was denoted as seed emulsion T-A4.

The tabular seed grain emulsion T-A4 was comprised of tabular grains, and it was proved that 50% of the total grain projected area was accounted for tabular grains having an aspect ratio of at least 20, an average aspect ratio of 18, an average equivalent circle diameter of 0.72 μm, a coefficient of variation of equivalent circle diameter of 23%, an average grain thickness of 0.04 μm and an average spacing between twin planes of 100 A. It was further proved that 96% by number of the grains-was accounted for by tabular grains having two twin planes parallel to the major faces.

Preparation of Tabular Silver Halide Grain Emulsion Em-6

Tabular silver halide grain emulsion Em-6 was prepared similarly to the foregoing emulsion Em-5, except that the tabular seed grain emulsion T-A3 was replaced by seed grain emulsion T-A4.

Analysis of emulsion Em-6 revealed that at least 95% of the total grain projection area was accounted for by tabular grains having an average aspect ratio of 28 and an average equivalent circle diameter of 3.4 μm, a coefficient of variation of equivalent circle diameter of 22%, an average grain thickness of 0.12 μm and an average spacing between twin planes of 100 A, and 96% by number of the grain was accounted for by tabular grains having two twin planes parallel to the major faces. It was also proved that 95% by number of the grain was accounted for by hexagonal tabular silver halide grains, in which 94% by number was accounted for by hexagonal grains having an adjacent edge ratio of not less than 1.0 and less than 1.2, and 90% by number was accounted for by hexagonal grains having an adjacent edge ratio of not less than 1.0 and less than 1.1. It was further proved that 94% by number of the tabular silver halide grains contained dislocation lines, of which 90% by number contained dislocation lines in the fringe portions and the major faces, 91% by number contained at least 10 dislocation lines in the fringe portions and 75% by number contained at least 30 dislocation lines in the fringe portions. It was further proved that silver halide grains contained in the tabular silver halide emulsion Em-6 had an average overall iodide content of 3.5 mol % and an average surface iodide content of 8.4 mol %; a coefficient of variation of spacing between twin planes was 21%, a coefficient of variation of grain thickness was 20%, the proportion of (100) face of the total surfaces of the tabular grains was 28%, the proportion of heteromorphic grains was 0.1% by number and the proportion of heteromorphic twinned grains was 0.07% by number.

Preparation of Tabular Seed Emulsion T-A5

In accordance with the following procedure, tabular seed emulsion T-A5 was prepared.

Nucleation Process

A 20.4 lit. aqueous solution containing 91.9 g of oxidized gelatin B (methionine content of 0.1 μmol/g) and 24.0 g of potassium bromide was maintained at 20° C. in a reaction vessel and adjusted to a pH of 1.90 using an aqueous 0.5 mol/l sulfuric acid solution, while stirring at a high speed using a mixing stirrer, as described in JP-A No. 62-160128. Thereafter, the following solutions, S-01d and X-01d were added by double jet addition in one minute to perform nucleation and then, solution G-01d was further added thereto.

S-01d Solution: 88.75 ml of 1.25 mol/l aqueous silver nitrate solution,

X-01d Solution: 88.75 ml of 1.25 mol/l aqueous potassium bromide solution,

G-01d Solution: 2640 ml of aqueous solution containing 101.4 g of oxidized gelatin B and 3.78 ml of a 10% methanol solution of surfactant (EO-1).

Ripening Process

After completion of the nucleation process, the temperature was raised to 75° C. in 45 min. and then, the pAg was adjusted to 8.6 using a 1.75 mol/l aqueous potassium bromide solution in 30 min. from the start of raising the temperature, and after adding 96.8 ml of an aqueous solution containing 12.6 g of ammonium nitrate at 35 min. from the start of raising the temperature, 285 ml of a 10% aqueous potassium hydroxide solution was added and maintained for 5 min. 30 sec. Then, the reaction mixture was adjusted to a pH of 7.6 with a 56% aqueous acetic solution.

Growth Process

After completion of the ripening process, the pAg was adjusted to 8.8 with a 1.75 mol/l aqueous potassium bromide solution, and then, solutions S-02d and X-02d were added by double jet addition at an accelerated flow rate for 5 min., while maintaining the pH at 6.1 with a 56% aqueous acetic acid solution.

S-02d Solution: 1130 ml of 1.25 mol/l aqueous silver nitrate solution,

X-02d Solution: 1130 ml of 1.25 mol/l aqueous potassium bromide solution.

After completion of addition of respective solutions, the resulting emulsion was desalted by using an aqueous Demol (produced by Kao-Atlas) and an aqueous magnesium sulfate solution, and alkali-processed inert gelatin B (methionine content of 50.0 μmol/g) was added thereto and dispersed. The thus obtained emulsion was denoted as seed emulsion T-A5.

The tabular seed grain emulsion T-A5 was comprised of tabular grains, and it was proved that 50% of the total grain projected area was accounted for tabular grains having an aspect ratio of at least 25, an average aspect ratio of 22, an average equivalent circle diameter of 0.78 μm, a coefficient of variation of equivalent circle diameter of 25%, an average grain thickness of 0.035 μm and an average spacing between twin planes of 90 A. It was further proved that 97% by number of the grains was accounted for by tabular grains having two twin planes parallel to the major faces.

Preparation of Tabular Silver Halide Grain Emulsion Em-7

Tabular silver halide grain emulsion Em-7 was prepared similarly to the foregoing emulsion Em-5, except that the tabular seed grain emulsion T-A3 was replaced by seed grain emulsion T-A5, the amount of a 10% methanol solution of the foregoing surfactant EO-1 was 0.05 ml, the reaction mother liquor was varied to 50.8 lit. by adding water, solutions S-11 and S-11 were added with maintaining the pAg at 9.3, and after completion of the addition of solutions S-11 and S-11, the reaction mixture solution was subjected to ultrafiltration for 30 min. to remove 35.0 lit. of liquid containing soluble components.

Analysis of emulsion Em-7 revealed that at least 95% of the total grain projection area was accounted for by tabular grains having an average aspect ratio of 41 and an average equivalent circle diameter of 3.7 μm, a coefficient of variation of equivalent circle diameter of 25%, an average grain thickness of 0.09 μm and an average spacing between twin planes of 90 A, and 97% by number of the grain was accounted for by tabular grains having two twin planes parallel to the major faces. It was also proved that 95% by number of the grain was accounted for by hexagonal tabular silver halide grains, in which 93% by number was accounted for by hexagonal grains having an adjacent edge ratio of not less than 1.0 and less than 1.2, and 91% by number was accounted for by hexagonal grains having an adjacent edge ratio of not less than 1.0 and less than 1.1. It was further proved that 93% by number of the tabular silver halide grains contained dislocation lines, of which 90% by number contained dislocation lines in the fringe portions and the major faces, 92% by number contained at least 10 dislocation lines in the fringe portions and 72% by number contained at least 30 dislocation lines in the fringe portions. It was further proved that silver halide grains contained in the tabular silver halide emulsion Em-7 had an average overall iodide content of 3.5 mol % and an average surface iodide content of 8.6 mol %; a coefficient of variation of spacing between twin planes was 20%, a coefficient of variation of grain thickness was 17%, the proportion of (100) face of the total surfaces of the tabular grains was 27%, the proportion of heteromorphic grains was 0.07% by number and the proportion of heteromorphic twinned grains was 0.03% by number.

Preparation of Tabular Silver Halide Grain Emulsion Em-8

Tabular silver halide grain emulsion Em-8 was prepared similarly to the foregoing emulsion Em-7, except that the following solution M-11a was added after addition of solution S-14 and before addition of solutions S-15 and X-15:

M-11a Solution: 132 ml of aqueous solution containing 239.7 mg of $K_4[Fe(CN)_6]$.

Analysis of emulsion Em-8 revealed that at least 95% of the total grain projection area was accounted for by tabular grains having an average aspect ratio of 41 and an average equivalent circle diameter of 3.7 μm, a coefficient of variation of equivalent circle diameter of 25%, an average grain thickness of 0.09 μm and an average spacing between twin planes of 90 A, and 97% by number of the grain was accounted for by tabular grains having two twin planes parallel to the major faces. It was also proved that 95% by number of the grain was accounted for by hexagonal tabular silver halide grains, in which 93% by number was accounted for by hexagonal grains having an adjacent edge ratio of not less than 1.0 and less than 1.2, and 91% by number was accounted for by hexagonal grains having an adjacent edge ratio of not less than 1.0 and less than 1.1. It was further proved that 93% by number of the tabular silver halide grains contained dislocation lines, of which 90% by number contained dislocation lines in the fringe portions and the major faces, 92% by number contained at least 10 dislocation lines in the fringe portions and 72% by number contained at least 30 dislocation lines in the fringe portions. It was further proved that silver halide grains contained in the tabular silver halide emulsion Em-8 had an average overall iodide content of 3.5 mol % and an average surface iodide content of 8.6 mol %; a coefficient of variation of spacing between twin planes was 20%, a coefficient of variation of grain thickness was 17%, the proportion of (100) face of the total surfaces of the tabular grains was 27%, the proportion of heteromorphic grains was 0.07% by number and the proportion of heteromorphic twinned grains was 0.03% by number.

Preparation of Tabular Silver Halide Grain Emulsion Em-9

Tabular silver halide grain emulsion Em-9 was prepared similarly to the foregoing emulsion Em-7, except that the following solution M-11b was added after addition of solution S-14 and before addition of solutions S-15 and X-15:

M-11b Solution: 132 ml of aqueous solution containing 234.7 mg of $K_4[Ru(CN)_6]$.

Analysis of emulsion Em-9 revealed that at least 95% of the total grain projection area was accounted for by tabular grains having an average aspect ratio of 41 and an average equivalent circle diameter of 3.7 μm, a coefficient of variation of equivalent circle diameter of 25%, an average grain thickness of 0.09 μm and an average spacing between twin planes of 90 A, and 97% by number of the grain was accounted for by tabular grains having two twin planes parallel to the major faces. It was also proved that 95% by number of the grain was accounted for by hexagonal tabular silver halide grains, in which 93% by number was accounted for by hexagonal grains having an adjacent edge ratio of not less than 1.0 and less than 1.2, and 91% by number was accounted for by hexagonal grains having an adjacent edge ratio of not less than 1.0 and less than 1.1. It was further proved that 93% by number of the tabular silver halide grains contained dislocation lines, of which 90% by number contained dislocation lines in the fringe portions and the major faces, 92% by number contained at least 10 dislocation lines in the fringe portions and 72% by number contained at least 30 dislocation lines in the fringe portions. It was further proved that silver halide grains contained in the tabular silver halide emulsion Em-9 had an average overall iodide content of 3.5 mol % and an average surface iodide content of 8.6 mol %; a coefficient of variation of spacing between twin planes was 20%, a coefficient of variation of grain thickness was 17%, the proportion of (100) face of the total surfaces of the tabular grains was 27%, the proportion of heteromorphic grains was 0.07% by number and the proportion of heteromorphic twinned grains was 0.03% by number.

After heated to 57° C., the thus prepared emulsion Em-1 was added with a sensitizing dyes as used in the 9th layer of a color photographic material described later, trifurylphosphineselenide, chloroauric acid, potassium thiocyanate and sodium thiosulfate pentahydrate and then chemically ripened at a silver potential of 50 mV and a pH of 6.5 so as to achieve optimum sensitivity. After completion of chemical ripening, 6-methyl-4-hydroxy-1,3,3a,7-tetrazaindene, disulfide compound (1–6) described below, and fine silver iodide grains were further added to the emulsion and the emulsion was cooled and solidified to complete spectral sensitization and chemical sensitization.

Emulsions Em-2 through Em-9 were similarly ripened, provided that amounts of the sensitizing dyes used in the respective emulsions were adjusted so that the amount of the dyes per surface area of the silver halide grains was identical.

1-6

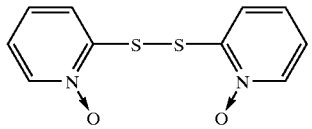

Preparation of Silver Halide Color Photographic Material

Preparation of Sample No. 1001 through 1009

On a 120 μm thick, subbed polyethyleneterephthalate film support, the following layers having composition as shown below were formed to prepare a multi-layered color photographic material samples. The addition amount of each compound was represented in term of g/m$^2$, unless otherwise noted. The amount of silver halide or colloidal silver was converted to the silver amount and the amount of a sensitizing dye (designated as "SD") was represented in mol/Ag mol.

The foregoing tabular silver halide emulsions Em-1 through Em-9 were respectively used as silver iodobromide emulsion G used in the 9th layer described below to prepare photographic material samples No. 1001 through 1009.

| | |
|---|---|
| 1st Layer: Anti-Halation Layer | |
| Black colloidal silver | 0.16 |
| UV-1 | 0.30 |
| F-1 | 0.012 |
| CM-1 | 0.12 |
| OIL-1 | 0.25 |
| Gelatin | 1.40 |
| 2nd Layer: Interlayer | |
| AS-1 | 0.12 |
| OIL-1 | 0.15 |
| Gelatin | 0.67 |
| 3rd Layer: Low-speed Red-Sensitive Layer | |
| Silver iodobromide emulsion A | 0.24 |
| Silver iodobromide emulsion B | 0.24 |
| Silver iodobromide emulsion C | 0.32 |
| SD-1 | $4.8 \times 10^{-4}$ |
| SD-2 | $7.1 \times 10^{-4}$ |
| SD-3 | $7.6 \times 10^{-5}$ |
| SD-4 | $2.0 \times 10^{-4}$ |
| C-1 | 0.18 |
| C-2 | 0.62 |
| CC-1 | 0.007 |
| OIL-2 | 0.48 |
| Gelatin | 1.88 |
| 4th Layer: Medium-speed Red-sensitive Layer | |
| Silver iodobromide emulsion D | 0.75 |
| Silver iodobromide emulsion A | 0.40 |
| SD-1 | $4.5 \times 10^{-4}$ |
| SD-2 | $5.9 \times 10^{-5}$ |
| SD-4 | $2.8 \times 10^{-4}$ |
| C-1 | 0.40 |
| CC-1 | 0.07 |
| DI-1 | 0.053 |
| OIL-2 | 0.26 |
| Gelatin | 1.36 |
| 5th Layer: High-speed Red-Sensitive Layer | |
| Silver iodobromide emulsion E | 1.56 |
| Silver iodobromide emulsion D | 0.17 |
| SD-1 | $2.1 \times 10^{-4}$ |
| SD-2 | $1.0 \times 10^{-4}$ |
| SD-4 | $2.8 \times 10^{-5}$ |
| SD-13 | $2.8 \times 10^{-4}$ |
| SD-9 | $1.5 \times 10^{-5}$ |

-continued

| | |
|---|---|
| C-1 | 0.12 |
| C-3 | 0.17 |
| CC-1 | 0.016 |
| DI-4 | 0.01 |
| DI-5 | 0.046 |
| OIL-2 | 0.18 |
| OIL-3 | 0.19 |
| Gelatin | 1.59 |
| 6th Layer: Interlayer | |
| Y-1 | 0.11 |
| AS-1 | 0.18 |
| OIL-1 | 0.26 |
| AF-6 | 0.001 |
| Gelatin | 1.00 |
| 7th Layer: Low-speed Green-Sensitive Layer | |
| Silver iodobromide emulsion F | 0.20 |
| Silver iodobromide emulsion C | 0.20 |
| SD-5 | $3.2 \times 10^{-5}$ |
| SD-6 | $5.0 \times 10^{-4}$ |
| SD-7 | $9.2 \times 10^{-5}$ |
| SD-8 | $1.6 \times 10^{-4}$ |
| M-1 | 0.33 |
| CM-1 | 0.052 |
| DI-2 | 0.013 |
| AS-2 | 0.001 |
| OIL-1 | 0.35 |
| Gelatin | 1.13 |
| 8th Layer: Medium-speed Green-Sensitive Layer | |
| Silver iodobromide emulsion D | 0.52 |
| Silver iodobromide emulsion F | 0.22 |
| SD-5 | $3.0 \times 10^{-5}$ |
| SD-6 | $4.2 \times 10^{-4}$ |
| SD-7 | $1.8 \times 10^{-4}$ |
| SD-8 | $1.6 \times 10^{-4}$ |
| M-1 | 0.14 |
| CM-1 | 0.043 |
| CM-2 | 0.044 |
| DI-3 | 0.0044 |
| DI-2 | 0.027 |
| AS-4 | 0.0059 |
| AS-3 | 0.015 |
| AS-5 | 0.043 |
| OIL-1 | 0.27 |
| Gelatin | 1.04 |
| 9th Layer: High-speed Green-Sensitive Layer | |
| Silver iodobromide emulsion G | 1.57 |
| SD-5 | $1.1 \times 10^{-4}$ |
| SD-6 | $5.1 \times 10^{-4}$ |
| SD-8 | $9.3 \times 10^{-5}$ |
| SD-9 | $1.5 \times 10^{-5}$ |
| M-1 | 0.052 |
| M-2 | 0.099 |
| CM-2 | 0.011 |
| DI-3 | 0.0034 |
| AS-2 | 0.0069 |
| AS-5 | 0.045 |
| AS-3 | 0.023 |
| OIL-1 | 0.28 |

-continued

| | |
|---|---|
| OIL-3 | 0.20 |
| Gelatin | 1.54 |
| 10th Layer: Yellow Filter Layer | |
| F-2 | 0.048 |
| F-3 | 0.04 |
| AS-1 | 0.15 |
| OIL-1 | 0.18 |
| Gelatin | 0.67 |
| 11th Layer: Low-speed Blue-sensitive Layer | |
| Silver iodobromide emulsion R | 0.19 |
| Silver iodobromide emulsion I | 0.24 |
| Silver iodobromide emulsion J | 0.11 |
| SD-12 | $3.4 \times 10^{-4}$ |
| SD-11 | $1.1 \times 10^{-4}$ |
| SD-10 | $2.1 \times 10^{-4}$ |
| SD-9 | $3.0 \times 10^{-5}$ |
| Y-1 | 1.09 |
| DI-6 | 0.021 |
| AS-2 | 0.0016 |
| OIL-1 | 0.33 |
| X-1 | 0.11 |
| Gelatin | 2.06 |
| 12th Layer: High-sped Blue-sensitive Layer | |
| Silver iodobromide emulsion K | 1.33 |
| Silver iodobromide emulsion I | 0.17 |
| Silver iodobromide emulsion L | 0.17 |
| SD-12 | $2.2 \times 10^{-4}$ |
| SD-10 | $3.6 \times 10^{-5}$ |
| SD-9 | $3.0 \times 10^{-5}$ |
| Y-1 | 0.30 |
| DI-5 | 0.11 |
| X-3 | 0.0022 |
| OIL-1 | 0.17 |
| X-1 | 0.11 |
| Calcium chloride | 0.0026 |
| OIL-3 | 0.07 |
| Gelatin | 1.30 |
| 13th Layer: First Protective Layer | |
| Silver iodobromide emulsion M | 0.30 |
| UV-1 | 0.11 |
| UV-2 | 0.056 |
| OIL-3 | 0.03 |
| X-1 | 0.078 |
| AF-6 | 0.006 |
| Gelatin | 0.80 |
| 14th Layer: Second protective Layer | |
| PM-1 | 0.13 |
| PM-2 | 0.018 |
| WAX-1 | 0.021 |
| Gelatin | 0.55 |

Characteristics of silver iodobromide emulsions A through M are shown below.

TABLE 1

| Emulsion | AgX Grain*1 | Av. Grain Diameter (μm)/CV (%)*2 | Av. Grain Thickness (μm)/CV (%)*3 | Av. Aspect Ratio/CV*4 | Av. Iodide Content (mol %) | Av. Surface Iodide Content (mol %) |
|---|---|---|---|---|---|---|
| A | core/shell, Tabular | 0.96/19.0 | 0.17/18.7 | 5.8/26.6 | 3.7 | 7.1 |
| B | core/shell, cubic | 0.47/6.0 | 0.42/4.2 | 1.1/6.0 | 4.0 | 7.4 |
| C | core/shell, cubic | 0.30/8.4 | 0.27/5.0 | 1.1/7.0 | 2.0 | 3.6 |
| D | core/shell, Tabular | 1.83/25.9 | 0.20/22.3 | 10.0/30.8 | 3.8 | 6.6 |
| E | core/shell, Tabular | 3.34/36.0 | 0.20/22.2 | 17.7/40.0 | 2.2 | 5.5 |

TABLE 1-continued

| Emulsion | AgX Grain*1 | Av. Grain Diameter (μm)/CV (%)*2 | Av. Grain Thickness (μm)/CV (%)*3 | Av. Aspect Ratio/CV*4 | Av. Iodide Content (mol %) | Av. Surface Iodide Content (mol %) |
|---|---|---|---|---|---|---|
| F | core/shell, Tabular | 0.96/19.0 | 0.17/18.7 | 5.8/26.6 | 3.7 | 7.1 |
| H | core/shell, Tabular | 1.31/14.7 | 0.39/22.0 | 3.5/22.6 | 7.9 | 8.6 |
| I | core/shell, Tabular | 0.96/19.0 | 0.17/18.7 | 5.8/26.6 | 3.7 | 7.5 |
| J | core/shell, cubic | 0.30/8.4 | 0.27/5.0 | 1.1/7.0 | 2.0 | 2.9 |
| K | core/shell, Tabular | 1.81/14.0 | 1.10/15.0 | 1.7/19.6 | 6.7 | 4.5 |
| M | homogeneous, tetradecahedral fine grain | 0.044/15.0 | 0.04/12.0 | 1.1/12.0 | 2.0 | 4.5 |
| L | homogeneous, Tabular | 0.45/37.0 | 0.10/50.0 | 5.1/39.0 | 2.0 | 4.8 |

*1characteristics of silver halide grains
*2average equivalent circle grain diameter (μm)/coefficient of variation of grain diameter (%)
*3average grain thickness (μm)/coefficient of variation of grain thickness (%)
*4average aspect ratio/coefficient of variation of aspect ratio Each of emulsions described in Table 1, except for emulsion M was added with sensitizing dyes described above and chemically sensitized so as to achieve an optimum relationship between sensitivity and fog.

Of emulsions described in Table 1, emulsion H through K were each subjected to reduction sensitization; emulsions A through F each occluded metal ions or metal complexes within the grains; emulsions A through K each contained dislocation lines within the grains; and in emulsions A, D through I and K, at least 50% by number was accounted for by grains containing at least 30 dislocation lines in the fringe portions and at least 80% by number was accounted for by grains having two twin planes parallel to the major faces.

In each sample were added coating aids SU-1, SU-2 and SU-3; a dispersing aid SU-4; viscosity-adjusting agent V-1; stabilizer ST-1; two kinds polyvinyl pyrrolidone of weight-averaged molecular weights of 10,000 and 100,000 (AF-1, AF-2); calcium chloride; inhibitors AF-3, AF-4, AF-5, and AF-7; hardener H-1; and antiseptic Ase-1.

Chemical structures of the compounds used in the foregoing sample are shown below.

Y-1

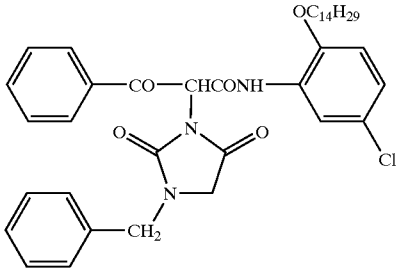

M-1

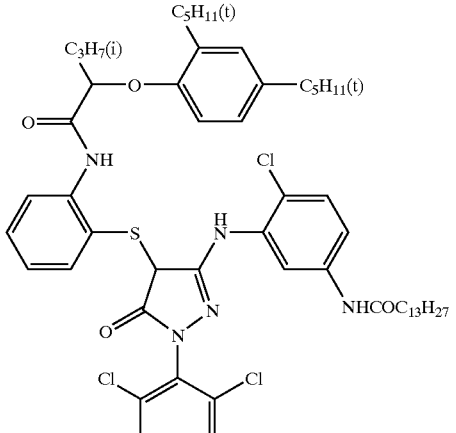

M-2

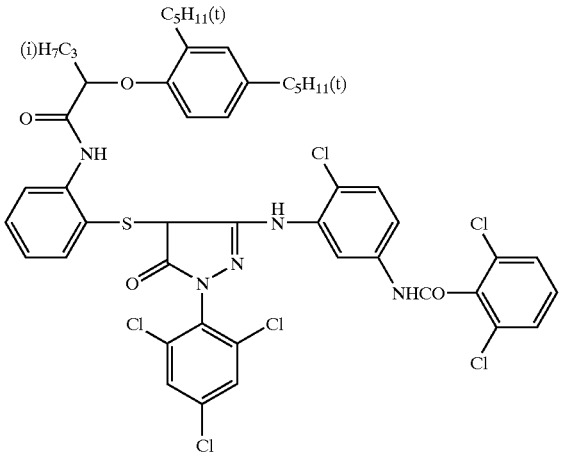

C-1

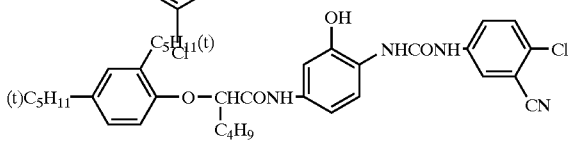

-continued
C-2
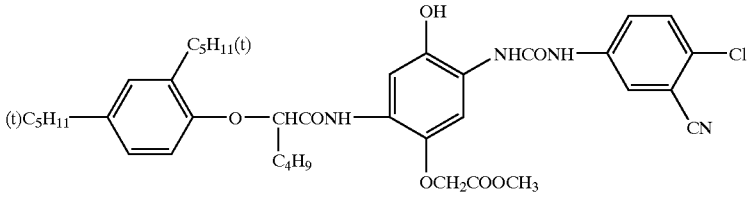
C-3
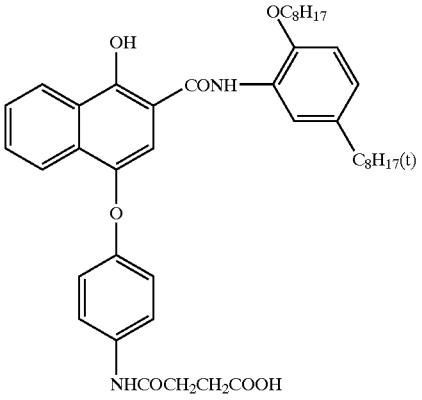
CC-1
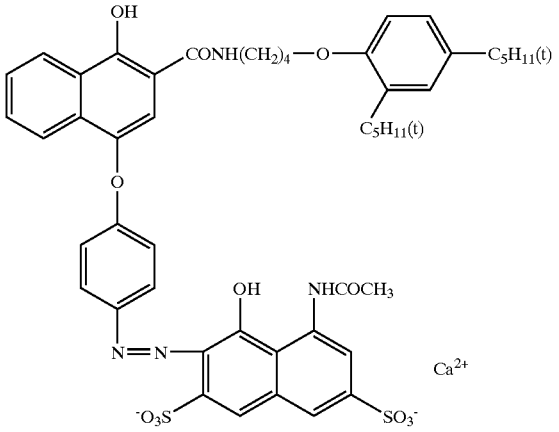
CM-1
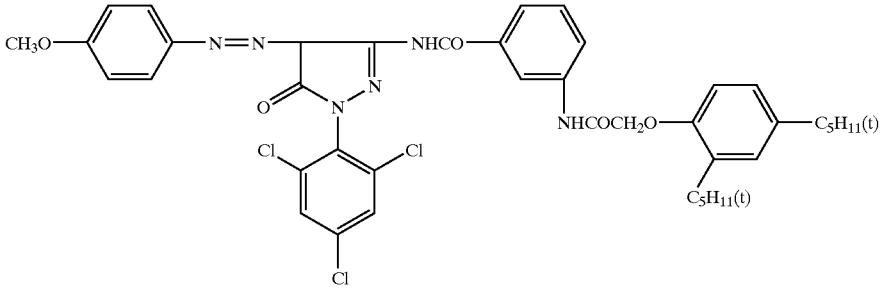
CM-2
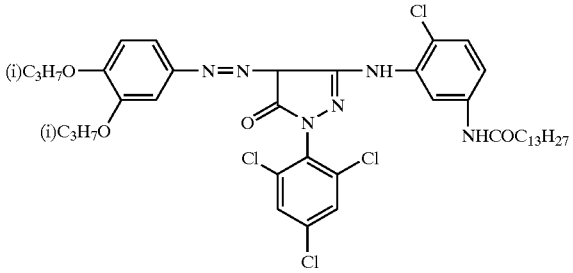
DI-6
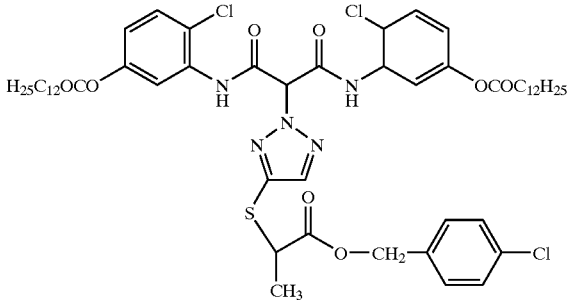

-continued
DI-1
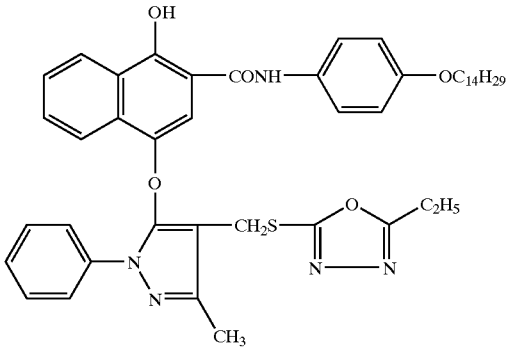
DI-2
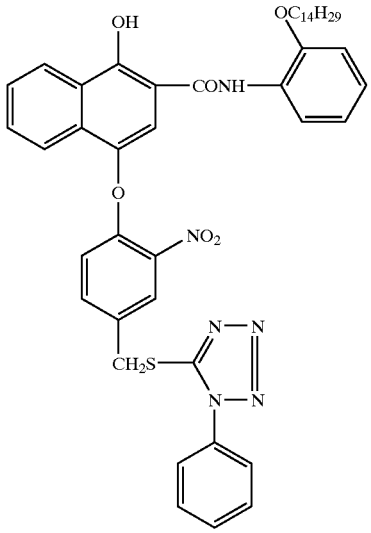
DI-3
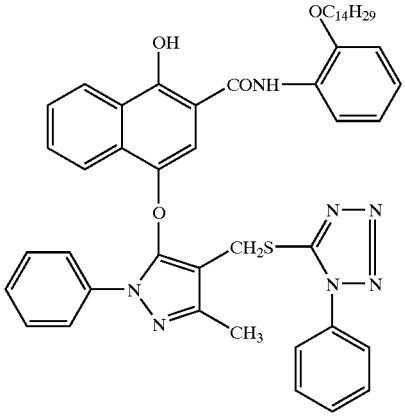
DI-4
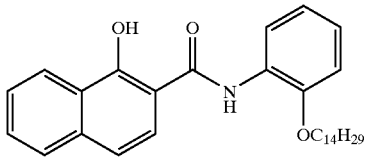
DI-5
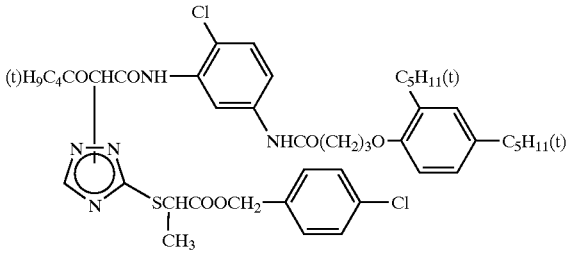
SD-1
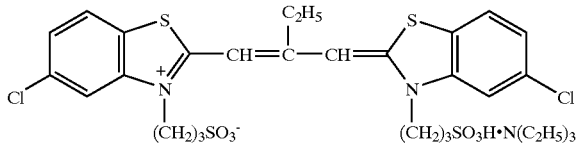
SD-2
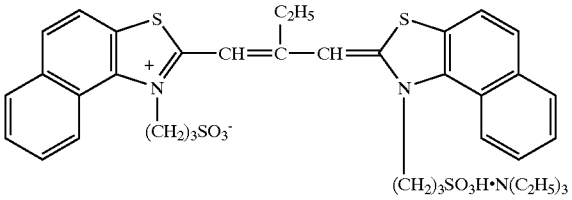
SD-3
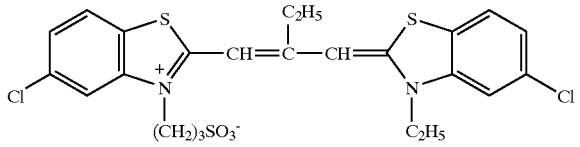
SD-4
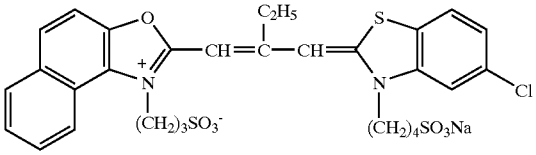
SD-5
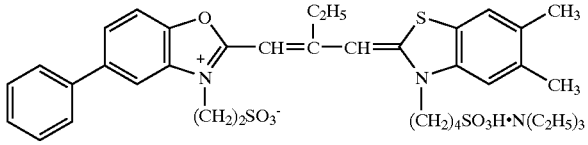

-continued
SD-6
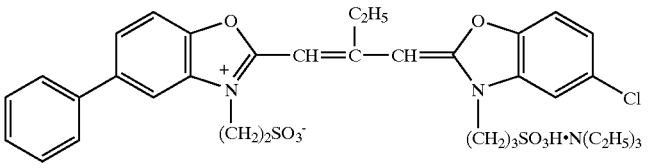
SD-7
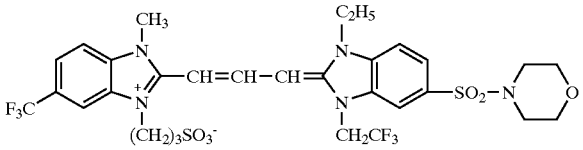
SD-8
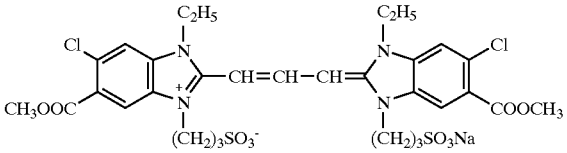
SD-9
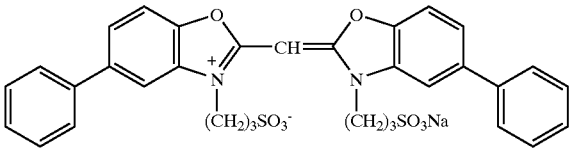
SD-10
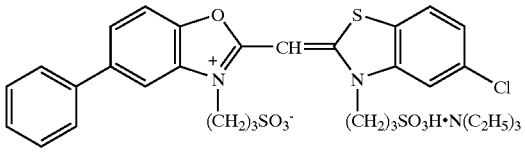
SD-11
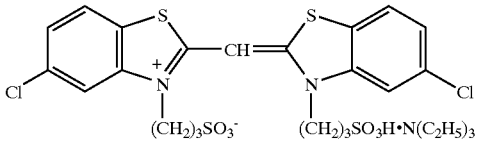
SD-12
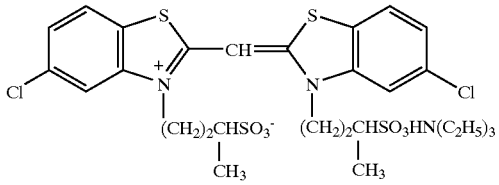
SD-13
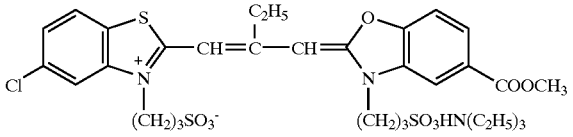
AS-1
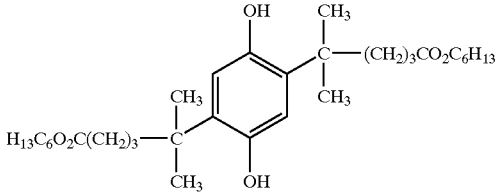
AS-2
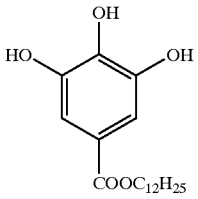
AS-3
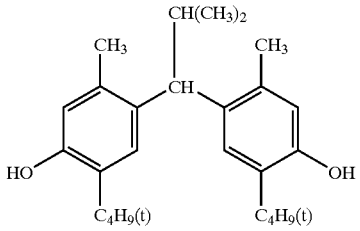
AS-4
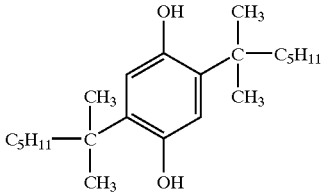
AS-5
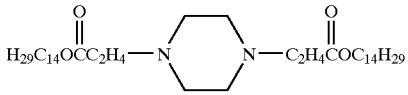

-continued
F-1
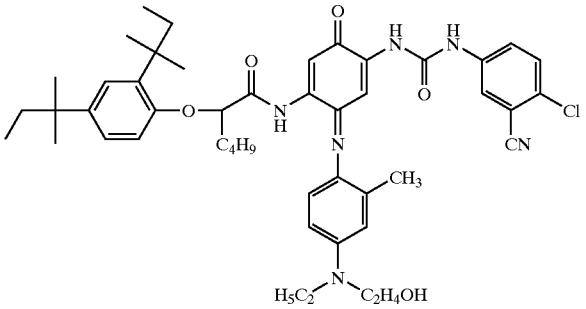
F-2
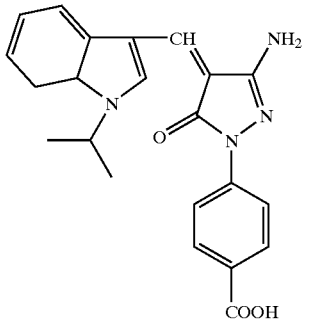
F-3
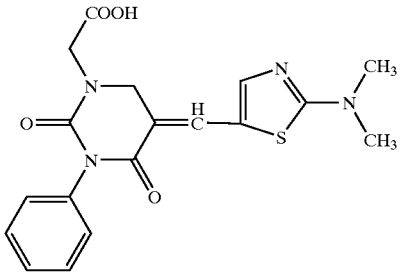
OIL-1
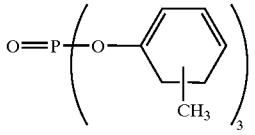
UV-1
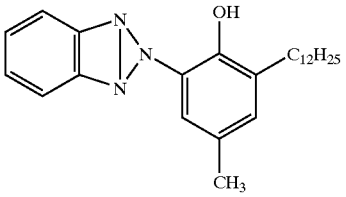
OIL-2
$H_9C_4OOC(CH_2)_8COOC_4H_9$
OIL-3
Liquid paraffin
UV-2
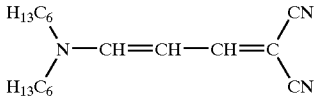
V-1
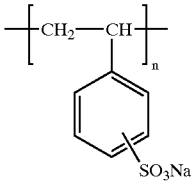
n: degree of polymerization
Ase-1 (mixture)
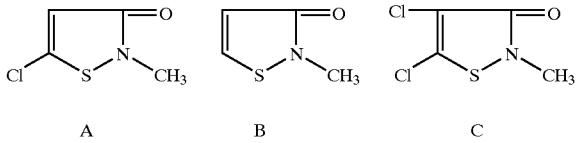
A B C
A:B:C = 50:46:4 (molar ratio)
H-1
$CH_2{=}CHSO_2{-}CH_2CONHC_2H_4NHCOCH_2{-}SO_2CH{=}CH_2$
ST-1
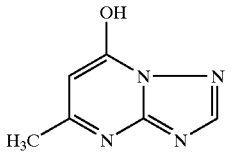
AF-1,2
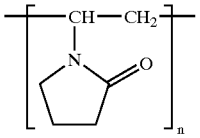
AF-3
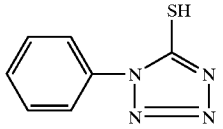
AF-1 Mw ≈ 10,000
AF-2 Mw ≈ 100,000
n: degree of polymerization -continued

AF-4

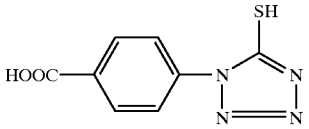

AF-5

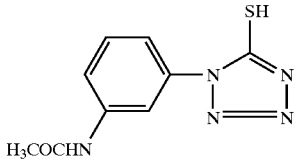

AF-6

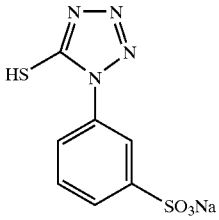

AF-7

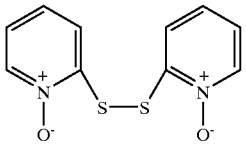

X-1

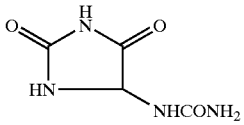

X-3

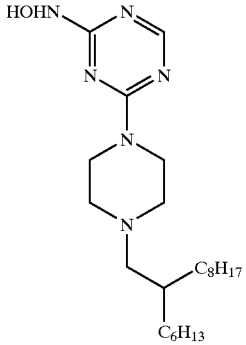

SU-1

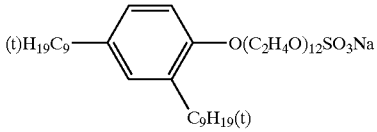

SU-2

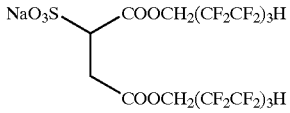

SU-3

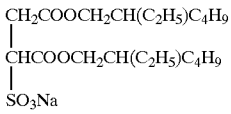

SU-4

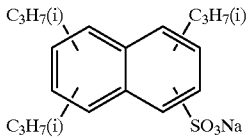

WAX-1

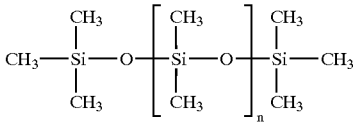

Mw = 3,000

PM-1

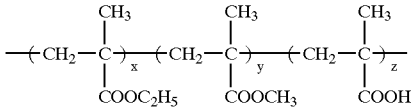

x:y:z = 3:3:4

PM-2

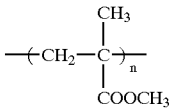

n: degree of polymerization

For each of the thus prepared samples were prepared two parts, one of which was exposed to radiation of 200 mR dose using 137 Cs as a radiation source. The other part was not exposed to any radiation (fresh samples immediately after coating). Thereafter, exposure and processing were carried out for each sample. Thus, samples were each exposed to light through an optical stepped wedge for a period of 1/200 sec., using white light and then processed in accordance with the process described in JP-A 10-123652, paragraph Nos. [0220] through [0227]. Subsequently, processed samples were measured with respect to magenta density, using a densitometer produced by X-rite Co. A characteristic curve of density (D) and exposure (Log E) was prepared to evaluate sensitivity. Sensitivity was represented by a relative value of the reciprocal of exposure necessary to give a magenta density of minimum density plus 0.10, based on the sensitivity of radiation-unexposed sample 1001 (obtained immediately after coating) being 100. Resistance to radiation, i.e., sensitivity stability to radiation for each sample was evaluated based on the following formula:

Sensitivity stability=(sensitivity of sample exposed to radiation)/(sensitivity of sample unexposed to radiation)×100

Further, RMS granularity was measured (i.e., 1000 times value of variation in density occurred when a density of minimum density plus 0.30 was scanned with microdensitometer, product by Konica Corp. at a aperture scanning area of 250 $\mu m^2$). Resistance to radiation with respect to graininess, i.e., stability of graininess to radiation (hereinafter, also denoted as graininess stability) was evaluated based on the following formula:

Graininess stability=(RMS value of sample exposed to radiation)/(RMS value of sample unexposed to radiation)×100

Samples and evaluation results thereof are shown in Table 2.

TABLE 2

| | | Fresh Sample | | Radiation Exposure | | |
|---|---|---|---|---|---|---|
| Sample No. | Emulsion*1 | Sensitivity | Graininess | Sensitivity Stability | Graininess Stability | Remark |
| 1001 | Em-1 | 100 | 100 | 74 | 129 | Comp. |
| 1002 | Em-2 | 113 | 90 | 85 | 113 | Inv. |
| 1003 | Em-3 | 115 | 82 | 87 | 111 | Inv. |
| 1004 | Em-4 | 124 | 77 | 90 | 105 | Inv. |
| 1005 | Em-5 | 124 | 77 | 95 | 103 | Inv. |
| 1006 | Em-6 | 133 | 75 | 96 | 103 | Inv. |
| 1007 | Em-7 | 145 | 75 | 97 | 103 | Inv. |
| 1008 | Em-8 | 155 | 75 | 97 | 102 | Inv. |
| 1009 | Em-9 | 158 | 75 | 97 | 102 | Inv. |

*1Emulsion used in the 9th layer

As apparent from Table 2, Samples 1002 through 1009 relating to the invention exhibited superior performance in sensitivity stability to radiation and graininess stability to radiation, relative to comparative Sample 1001.

What is claimed is:

1. A silver halide photographic emulsion comprising silver halide grains, wherein at least 70% of total grain projected area is accounted for by tabular grains, the tabular grains having an average aspect ratio of 20 to 500 and an average spacing between twin planes of 10 to 160 A, and at least 80% by number of the tabular grains being accounted for by hexagonal tabular grains having an adjacent edge ratio of not less than 1.0 and less than 1.2.

2. The silver halide emulsion of claim 1, wherein at least 50% by number of the tabular grains is accounted for by grains having at least 30 dislocation lines in fringe portions of the tabular grains.

3. The silver halide emulsion of claim 1, wherein at least 80% by number of the tabular grains is accounted for by hexagonal grains having an adjacent edge ratio of not less than 1.0 and not more than 1.1.

4. The silver halide emulsion of claim 1, wherein the tabular grains have an average aspect ratio of 25 to 500.

5. The silver halide emulsion of claim 1, wherein the tabular grains have an average equivalent circle diameter of 1.0 to 50.0 $\mu m$ and an average thickness of 0.005 to 0.1 $\mu m$.

6. The silver halide emulsion of claim 1, wherein heteromorphic grains accounts for 0 to 5% by number of total grains.

7. The silver halide emulsion of claim 1, wherein the tabular grains contain at least one selected from the group consisting of a polyvalent metal atom, polyvalent metal ion, polyvalent metal complex and polyvalent metal ion complex.

8. A silver halide photographic emulsion comprising silver halide grains, wherein the silver halide grains have an average aspect ratio of 20 to 500 and a spacing between twin planes of 10 to 160 A, and at least 80% by number of the silver halide grains is accounted for by hexagonal tabular grains having a adjacent edge ratio of not less than 1.0 and less than 1.2.

9. A silver halide photographic material comprising on a support at least one silver halide emulsion layer, wherein the silver halide emulsion layer comprises a silver emulsion comprising silver halide grains, and at least 70% of total grain projected area is accounted for by tabular grains, the tabular grains having an average aspect ratio of 20 to 500 and an average spacing between twin planes of 10 to 60 A, and at least 80% by number of the tabular grains being accounted for by hexagonal tabular grains having an adjacent edge ratio of not less than 1.0 and less than 1.2.

* * * * *